US009940906B2

(12) United States Patent
Akaishi

(10) Patent No.: US 9,940,906 B2
(45) Date of Patent: Apr. 10, 2018

(54) STORAGE DEVICE, DISPLAY DRIVER, ELECTRO-OPTICAL DEVICE, AND ELECTRONIC APPARATUS

(71) Applicant: SEIKO EPSON CORPORATION, Tokyo (JP)

(72) Inventor: Susumu Akaishi, Chino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 32 days.

(21) Appl. No.: 15/082,096

(22) Filed: Mar. 28, 2016

(65) Prior Publication Data

US 2016/0284320 A1 Sep. 29, 2016

(30) Foreign Application Priority Data

Mar. 27, 2015 (JP) ..... 2015-066224

(51) Int. Cl.
*G09G 5/24* (2006.01)
*G09G 5/36* (2006.01)
*G09G 5/39* (2006.01)

(52) U.S. Cl.
CPC ..... *G09G 5/36* (2013.01); *G09G 5/24* (2013.01); *G09G 5/39* (2013.01); *G09G 2310/0278* (2013.01); *G09G 2310/0291* (2013.01)

(58) Field of Classification Search
None
See application file for complete search history.

(56) References Cited

U.S. PATENT DOCUMENTS

2003/0169244 A1* 9/2003 Kurokawa ..... G09G 5/395 345/204
2005/0280653 A1* 12/2005 Tsukamoto ..... G09G 5/001 345/558
2008/0122855 A1* 5/2008 Sonoyama ..... G09G 3/20 345/531
2008/0252654 A1* 10/2008 Hidaka ..... G09G 3/3688 345/593

FOREIGN PATENT DOCUMENTS

JP 2004-341217 A 12/2004
JP 2008-211077 A 9/2008

* cited by examiner

*Primary Examiner* — Ryan M Gray
(74) *Attorney, Agent, or Firm* — Oliff PLC

(57) ABSTRACT

A write circuit of a storage device, in a first mode, writes a plurality of first pixel data units, each of the first pixel data units being constituted by data for pixels that are on the same data line and on different scan lines in a display panel, into a plurality of memory cells connected to a selected word line, and in a second mode, writes a plurality of second pixel data units, each of the second pixel data units being constituted by data for pixels that are on the same scan line and on different data lines in the display panel, into a plurality of memory cells connected to a selected word line.

8 Claims, 13 Drawing Sheets

| | WL1 | WL2 | WL3 | | WL15 | WL16 | | WL600 |
|---|---|---|---|---|---|---|---|---|
| BL1 | SC1/DL1 | SC1/DL9 | SC1/DL17 | | SC1/DL113 | SC9/DL1 | | SC313/DL113 |
| BL2 | SC2/DL1 | SC2/DL9 | SC2/DL17 | | SC2/DL113 | SC10/DL1 | | SC314/DL113 |
| BL3 | SC3/DL1 | SC3/DL9 | SC3/DL17 | | SC3/DL113 | SC11/DL1 | | SC315/DL113 |
| BL4 | SC4/DL1 | SC4/DL9 | SC4/DL17 | | SC4/DL113 | SC12/DL1 | | SC316/DL113 |
| BL5 | SC5/DL1 | SC5/DL9 | SC5/DL17 | | SC5/DL113 | SC13/DL1 | | SC317/DL113 |
| BL6 | SC6/DL1 | SC6/DL9 | SC6/DL17 | | SC6/DL113 | SC14/DL1 | | SC318/DL113 |
| BL7 | SC7/DL1 | SC7/DL9 | SC7/DL17 | | SC7/DL113 | SC15/DL1 | | SC319/DL113 |
| BL8 | SC8/DL1 | SC8/DL9 | SC8/DL17 | | SC8/DL113 | SC16/DL1 | | SC320/DL113 |
| BL9 | SC1/DL2 | SC1/DL10 | SC1/DL18 | | SC1/DL114 | SC9/DL2 | | SC313/DL114 |
| BL10 | SC2/DL2 | SC2/DL10 | SC2/DL18 | | SC2/DL114 | SC10/DL2 | | SC314/DL114 |
| BL11 | SC3/DL2 | SC3/DL10 | SC3/DL18 | | SC3/DL114 | SC11/DL2 | | SC315/DL114 |
| BL12 | SC4/DL2 | SC4/DL10 | SC4/DL18 | | SC4/DL114 | SC12/DL2 | | SC316/DL114 |
| BL13 | SC5/DL2 | SC5/DL10 | SC5/DL18 | | SC5/DL114 | SC13/DL2 | | SC317/DL114 |
| BL14 | SC6/DL2 | SC6/DL10 | SC6/DL18 | | SC6/DL114 | SC14/DL2 | | SC318/DL114 |
| BL15 | SC7/DL2 | SC7/DL10 | SC7/DL18 | | SC7/DL114 | SC15/DL2 | | SC319/DL114 |
| BL16 | SC8/DL2 | SC8/DL10 | SC8/DL18 | | SC8/DL114 | SC16/DL2 | | SC320/DL114 |
| BL17 | SC1/DL3 | SC1/DL11 | SC1/DL19 | | SC1/DL115 | SC9/DL3 | | SC313/DL115 |
| BL18 | SC2/DL3 | SC2/DL11 | SC2/DL19 | | SC2/DL115 | SC10/DL3 | | SC314/DL115 |
| BL19 | SC3/DL3 | SC3/DL11 | SC3/DL19 | | SC3/DL115 | SC11/DL3 | | SC315/DL115 |
| BL20 | SC4/DL3 | SC4/DL11 | SC4/DL19 | | SC4/DL115 | SC12/DL3 | | SC316/DL115 |
| BL21 | SC5/DL3 | SC5/DL11 | SC5/DL19 | | SC5/DL115 | SC13/DL3 | | SC317/DL115 |
| BL22 | SC6/DL3 | SC6/DL11 | SC6/DL19 | | SC6/DL115 | SC14/DL3 | | SC318/DL115 |
| BL23 | SC7/DL3 | SC7/DL11 | SC7/DL19 | | SC7/DL115 | SC15/DL3 | | SC319/DL115 |
| BL24 | SC8/DL3 | SC8/DL11 | SC8/DL19 | | SC8/DL115 | SC16/DL3 | | SC320/DL115 |
| BL25 | SC1/DL4 | SC1/DL12 | SC1/DL20 | | SC1/DL116 | SC9/DL4 | | SC313/DL116 |
| BL26 | SC2/DL4 | SC2/DL12 | SC2/DL20 | | SC2/DL116 | SC10/DL4 | | SC314/DL116 |
| BL27 | SC3/DL4 | SC3/DL12 | SC3/DL20 | | SC3/DL116 | SC11/DL4 | | SC315/DL116 |
| BL28 | SC4/DL4 | SC4/DL12 | SC4/DL20 | | SC4/DL116 | SC12/DL4 | | SC316/DL116 |
| BL29 | SC5/DL4 | SC5/DL12 | SC5/DL20 | | SC5/DL116 | SC13/DL4 | | SC317/DL116 |
| BL30 | SC6/DL4 | SC6/DL12 | SC6/DL20 | | SC6/DL116 | SC14/DL4 | | SC318/DL116 |
| BL31 | SC7/DL4 | SC7/DL12 | SC7/DL20 | | SC7/DL116 | SC15/DL4 | | SC319/DL116 |
| BL32 | SC8/DL4 | SC8/DL12 | SC8/DL20 | ... | SC8/DL116 | SC16/DL4 | ... | SC320/DL116 |
| BL33 | SC1/DL5 | SC1/DL13 | SC1/DL21 | | SC1/DL117 | SC9/DL5 | | SC313/DL117 |
| BL34 | SC2/DL5 | SC2/DL13 | SC2/DL21 | | SC2/DL117 | SC10/DL5 | | SC314/DL117 |
| BL35 | SC3/DL5 | SC3/DL13 | SC3/DL21 | | SC3/DL117 | SC11/DL5 | | SC315/DL117 |
| BL36 | SC4/DL5 | SC4/DL13 | SC4/DL21 | | SC4/DL117 | SC12/DL5 | | SC316/DL117 |
| BL37 | SC5/DL5 | SC5/DL13 | SC5/DL21 | | SC5/DL117 | SC13/DL5 | | SC317/DL117 |
| BL38 | SC6/DL5 | SC6/DL13 | SC6/DL21 | | SC6/DL117 | SC14/DL5 | | SC318/DL117 |
| BL39 | SC7/DL5 | SC7/DL13 | SC7/DL21 | | SC7/DL117 | SC15/DL5 | | SC319/DL117 |
| BL40 | SC8/DL5 | SC8/DL13 | SC8/DL21 | | SC8/DL117 | SC16/DL5 | | SC320/DL117 |
| BL41 | SC1/DL6 | SC1/DL14 | SC1/DL22 | | SC1/DL118 | SC9/DL6 | | SC313/DL118 |
| BL42 | SC2/DL6 | SC2/DL14 | SC2/DL22 | | SC2/DL118 | SC10/DL6 | | SC314/DL118 |
| BL43 | SC3/DL6 | SC3/DL14 | SC3/DL22 | | SC3/DL118 | SC11/DL6 | | SC315/DL118 |
| BL44 | SC4/DL6 | SC4/DL14 | SC4/DL22 | | SC4/DL118 | SC12/DL6 | | SC316/DL118 |
| BL45 | SC5/DL6 | SC5/DL14 | SC5/DL22 | | SC5/DL118 | SC13/DL6 | | SC317/DL118 |
| BL46 | SC6/DL6 | SC6/DL14 | SC6/DL22 | | SC6/DL118 | SC14/DL6 | | SC318/DL118 |
| BL47 | SC7/DL6 | SC7/DL14 | SC7/DL22 | | SC7/DL118 | SC15/DL6 | | SC319/DL118 |
| BL48 | SC8/DL6 | SC8/DL14 | SC8/DL22 | | SC8/DL118 | SC16/DL6 | | SC320/DL118 |
| BL49 | SC1/DL7 | SC1/DL15 | SC1/DL23 | | SC1/DL119 | SC9/DL7 | | SC313/DL119 |
| BL50 | SC2/DL7 | SC2/DL15 | SC2/DL23 | | SC2/DL119 | SC10/DL7 | | SC314/DL119 |
| BL51 | SC3/DL7 | SC3/DL15 | SC3/DL23 | | SC3/DL119 | SC11/DL7 | | SC315/DL119 |
| BL52 | SC4/DL7 | SC4/DL15 | SC4/DL23 | | SC4/DL119 | SC12/DL7 | | SC316/DL119 |
| BL53 | SC5/DL7 | SC5/DL15 | SC5/DL23 | | SC5/DL119 | SC13/DL7 | | SC317/DL119 |
| BL54 | SC6/DL7 | SC6/DL15 | SC6/DL23 | | SC6/DL119 | SC14/DL7 | | SC318/DL119 |
| BL55 | SC7/DL7 | SC7/DL15 | SC7/DL23 | | SC7/DL119 | SC15/DL7 | | SC319/DL119 |
| BL56 | SC8/DL7 | SC8/DL15 | SC8/DL23 | | SC8/DL119 | SC16/DL7 | | SC320/DL119 |
| BL57 | SC1/DL8 | SC1/DL16 | SC1/DL24 | | SC1/DL120 | SC9/DL8 | | SC313/DL120 |
| BL58 | SC2/DL8 | SC2/DL16 | SC2/DL24 | | SC2/DL120 | SC10/DL8 | | SC314/DL120 |
| BL59 | SC3/DL8 | SC3/DL16 | SC3/DL24 | | SC3/DL120 | SC11/DL8 | | SC315/DL120 |
| BL60 | SC4/DL8 | SC4/DL16 | SC4/DL24 | | SC4/DL120 | SC12/DL8 | | SC316/DL120 |
| BL61 | SC5/DL8 | SC5/DL16 | SC5/DL24 | | SC5/DL120 | SC13/DL8 | | SC317/DL120 |
| BL62 | SC6/DL8 | SC6/DL16 | SC6/DL24 | | SC6/DL120 | SC14/DL8 | | SC318/DL120 |
| BL63 | SC7/DL8 | SC7/DL16 | SC7/DL24 | | SC7/DL120 | SC15/DL8 | | SC319/DL120 |
| BL64 | SC8/DL8 | SC8/DL16 | SC8/DL24 | | SC8/DL120 | SC16/DL8 | | SC320/DL120 |

FIG. 4

| | WL1 | WL2 | WL3 | | WL15 | WL16 | | WL600 |
|---|---|---|---|---|---|---|---|---|
| BL1 | SC1/DL1 | SC1/DL9 | SC1/DL17 | | SC1/DL113 | SC9/DL1 | | SC313/DL113 |
| BL2 | SC1/DL2 | SC1/DL10 | SC1/DL18 | | SC1/DL114 | SC9/DL2 | | SC313/DL114 |
| BL3 | SC1/DL3 | SC1/DL11 | SC1/DL19 | | SC1/DL115 | SC9/DL3 | | SC313/DL115 |
| BL4 | SC1/DL4 | SC1/DL12 | SC1/DL20 | | SC1/DL116 | SC9/DL4 | | SC313/DL116 |
| BL5 | SC1/DL5 | SC1/DL13 | SC1/DL21 | | SC1/DL117 | SC9/DL5 | | SC313/DL117 |
| BL6 | SC1/DL6 | SC1/DL14 | SC1/DL22 | | SC1/DL118 | SC9/DL6 | | SC313/DL118 |
| BL7 | SC1/DL7 | SC1/DL15 | SC1/DL23 | | SC1/DL119 | SC9/DL7 | | SC313/DL119 |
| BL8 | SC1/DL8 | SC1/DL16 | SC1/DL24 | | SC1/DL120 | SC9/DL8 | | SC313/DL120 |
| BL9 | SC2/DL1 | SC2/DL9 | SC2/DL17 | | SC2/DL113 | SC10/DL1 | | SC314/DL113 |
| BL10 | SC2/DL2 | SC2/DL10 | SC2/DL18 | | SC2/DL114 | SC10/DL2 | | SC314/DL114 |
| BL11 | SC2/DL3 | SC2/DL11 | SC2/DL19 | | SC2/DL115 | SC10/DL3 | | SC314/DL115 |
| BL12 | SC2/DL4 | SC2/DL12 | SC2/DL20 | | SC2/DL116 | SC10/DL4 | | SC314/DL116 |
| BL13 | SC2/DL5 | SC2/DL13 | SC2/DL21 | | SC2/DL117 | SC10/DL5 | | SC314/DL117 |
| BL14 | SC2/DL6 | SC2/DL14 | SC2/DL22 | | SC2/DL118 | SC10/DL6 | | SC314/DL118 |
| BL15 | SC2/DL7 | SC2/DL15 | SC2/DL23 | | SC2/DL119 | SC10/DL7 | | SC314/DL119 |
| BL16 | SC2/DL8 | SC2/DL16 | SC2/DL24 | | SC2/DL120 | SC10/DL8 | | SC314/DL120 |
| BL17 | SC3/DL1 | SC3/DL9 | SC3/DL17 | | SC3/DL113 | SC11/DL1 | | SC315/DL113 |
| BL18 | SC3/DL2 | SC3/DL10 | SC3/DL18 | | SC3/DL114 | SC11/DL2 | | SC315/DL114 |
| BL19 | SC3/DL3 | SC3/DL11 | SC3/DL19 | | SC3/DL115 | SC11/DL3 | | SC315/DL115 |
| BL20 | SC3/DL4 | SC3/DL12 | SC3/DL20 | | SC3/DL116 | SC11/DL4 | | SC315/DL116 |
| BL21 | SC3/DL5 | SC3/DL13 | SC3/DL21 | | SC3/DL117 | SC11/DL5 | | SC315/DL117 |
| BL22 | SC3/DL6 | SC3/DL14 | SC3/DL22 | | SC3/DL118 | SC11/DL6 | | SC315/DL118 |
| BL23 | SC3/DL7 | SC3/DL15 | SC3/DL23 | | SC3/DL119 | SC11/DL7 | | SC315/DL119 |
| BL24 | SC3/DL8 | SC3/DL16 | SC3/DL24 | | SC3/DL120 | SC11/DL8 | | SC315/DL120 |
| BL25 | SC4/DL1 | SC4/DL9 | SC4/DL17 | | SC4/DL113 | SC12/DL1 | | SC316/DL113 |
| BL26 | SC4/DL2 | SC4/DL10 | SC4/DL18 | | SC4/DL114 | SC12/DL2 | | SC316/DL114 |
| BL27 | SC4/DL3 | SC4/DL11 | SC4/DL19 | | SC4/DL115 | SC12/DL3 | | SC316/DL115 |
| BL28 | SC4/DL4 | SC4/DL12 | SC4/DL20 | | SC4/DL116 | SC12/DL4 | | SC316/DL116 |
| BL29 | SC4/DL5 | SC4/DL13 | SC4/DL21 | | SC4/DL117 | SC12/DL5 | | SC316/DL117 |
| BL30 | SC4/DL6 | SC4/DL14 | SC4/DL22 | | SC4/DL118 | SC12/DL6 | | SC316/DL118 |
| BL31 | SC4/DL7 | SC4/DL15 | SC4/DL23 | | SC4/DL119 | SC12/DL7 | | SC316/DL119 |
| BL32 | SC4/DL8 | SC4/DL16 | SC4/DL24 | ... | SC4/DL120 | SC12/DL8 | ... | SC316/DL120 |
| BL33 | SC5/DL1 | SC5/DL9 | SC5/DL17 | | SC5/DL113 | SC13/DL1 | | SC317/DL113 |
| BL34 | SC5/DL2 | SC5/DL10 | SC5/DL18 | | SC5/DL114 | SC13/DL2 | | SC317/DL114 |
| BL35 | SC5/DL3 | SC5/DL11 | SC5/DL19 | | SC5/DL115 | SC13/DL3 | | SC317/DL115 |
| BL36 | SC5/DL4 | SC5/DL12 | SC5/DL20 | | SC5/DL116 | SC13/DL4 | | SC317/DL116 |
| BL37 | SC5/DL5 | SC5/DL13 | SC5/DL21 | | SC5/DL117 | SC13/DL5 | | SC317/DL117 |
| BL38 | SC5/DL6 | SC5/DL14 | SC5/DL22 | | SC5/DL118 | SC13/DL6 | | SC317/DL118 |
| BL39 | SC5/DL7 | SC5/DL15 | SC5/DL23 | | SC5/DL119 | SC13/DL7 | | SC317/DL119 |
| BL40 | SC5/DL8 | SC5/DL16 | SC5/DL24 | | SC5/DL120 | SC13/DL8 | | SC317/DL120 |
| BL41 | SC6/DL1 | SC6/DL9 | SC6/DL17 | | SC6/DL113 | SC14/DL1 | | SC318/DL113 |
| BL42 | SC6/DL2 | SC6/DL10 | SC6/DL18 | | SC6/DL114 | SC14/DL2 | | SC318/DL114 |
| BL43 | SC6/DL3 | SC6/DL11 | SC6/DL19 | | SC6/DL115 | SC14/DL3 | | SC318/DL115 |
| BL44 | SC6/DL4 | SC6/DL12 | SC6/DL20 | | SC6/DL116 | SC14/DL4 | | SC318/DL116 |
| BL45 | SC6/DL5 | SC6/DL13 | SC6/DL21 | | SC6/DL117 | SC14/DL5 | | SC318/DL117 |
| BL46 | SC6/DL6 | SC6/DL14 | SC6/DL22 | | SC6/DL118 | SC14/DL6 | | SC318/DL118 |
| BL47 | SC6/DL7 | SC6/DL15 | SC6/DL23 | | SC6/DL119 | SC14/DL7 | | SC318/DL119 |
| BL48 | SC6/DL8 | SC6/DL16 | SC6/DL24 | | SC6/DL120 | SC14/DL8 | | SC318/DL120 |
| BL49 | SC7/DL1 | SC7/DL9 | SC7/DL17 | | SC7/DL113 | SC15/DL1 | | SC319/DL113 |
| BL50 | SC7/DL2 | SC7/DL10 | SC7/DL18 | | SC7/DL114 | SC15/DL2 | | SC319/DL114 |
| BL51 | SC7/DL3 | SC7/DL11 | SC7/DL19 | | SC7/DL115 | SC15/DL3 | | SC319/DL115 |
| BL52 | SC7/DL4 | SC7/DL12 | SC7/DL20 | | SC7/DL116 | SC15/DL4 | | SC319/DL116 |
| BL53 | SC7/DL5 | SC7/DL13 | SC7/DL21 | | SC7/DL117 | SC15/DL5 | | SC319/DL117 |
| BL54 | SC7/DL6 | SC7/DL14 | SC7/DL22 | | SC7/DL118 | SC15/DL6 | | SC319/DL118 |
| BL55 | SC7/DL7 | SC7/DL15 | SC7/DL23 | | SC7/DL119 | SC15/DL7 | | SC319/DL119 |
| BL56 | SC7/DL8 | SC7/DL16 | SC7/DL24 | | SC7/DL120 | SC15/DL8 | | SC319/DL120 |
| BL57 | SC8/DL1 | SC8/DL9 | SC8/DL17 | | SC8/DL113 | SC16/DL1 | | SC320/DL113 |
| BL58 | SC8/DL2 | SC8/DL10 | SC8/DL18 | | SC8/DL114 | SC16/DL2 | | SC320/DL114 |
| BL59 | SC8/DL3 | SC8/DL11 | SC8/DL19 | | SC8/DL115 | SC16/DL3 | | SC320/DL115 |
| BL60 | SC8/DL4 | SC8/DL12 | SC8/DL20 | | SC8/DL116 | SC16/DL4 | | SC320/DL116 |
| BL61 | SC8/DL5 | SC8/DL13 | SC8/DL21 | | SC8/DL117 | SC16/DL5 | | SC320/DL117 |
| BL62 | SC8/DL6 | SC8/DL14 | SC8/DL22 | | SC8/DL118 | SC16/DL6 | | SC320/DL118 |
| BL63 | SC8/DL7 | SC8/DL15 | SC8/DL23 | | SC8/DL119 | SC16/DL7 | | SC320/DL119 |
| BL64 | SC8/DL8 | SC8/DL16 | SC8/DL24 | | SC8/DL120 | SC16/DL8 | | SC320/DL120 |

FIG. 6

STORAGE DEVICE, DISPLAY DRIVER, ELECTRO-OPTICAL DEVICE, AND ELECTRONIC APPARATUS

BACKGROUND

1. Technical Field

The present invention relates to storage devices, display drivers, electro-optical devices, electronic apparatuses, and the like.

2. Related Art

In a display driver that includes a RAM (storage device) for storing display data, display data that is transferred to the display driver from a CPU (processing unit) is written into the RAM from a CPU-side port, the display data stored in the RAM is read out from a panel-side port, and a display panel is driven.

As an example of such a display driver including a RAM, a technique is disclosed in JP-A-2004-341217 in which pixel data is loaded from the RAM as a pixel data signal, pieces of the pixel data are distributed to corresponding segment electrodes, and segment driving voltages are applied to the segment electrodes, when display is performed in a double matrix liquid display. Also, a memory cell structure of a multiport SRAM is disclosed in JP-A-2008-211077, as an example of a RAM including multiple ports.

In a display driver including a RAM, a vertical write mode and a horizontal write mode are used as the write modes when display data is written into the RAM. In the vertical write mode, display data of multiple pixels that are on the same data line and on different scan lines are input to the display driver as a data unit, and the data unit is written into the RAM. In the horizontal write mode, display data of multiple pixels that are on the same scan line and on different data lines are input to the display driver as a data unit, and the data unit is written into the RAM.

In order to deal with two different write modes such as those described above, a conversion circuit that performs serial/parallel conversion, for example, of the display data to be input to the RAM before the display data is written into the RAM needs to be provided external to the RAM. For example, in the case of a RAM into which display data is written in units of 8 bits, display data of an amount that is 8 bits multiplied by 8 needs to be provided before the display data is written into the RAM. Therefore, there is a problem in that, because a clock whose cycle time is 8 times longer than that of the operation clock of the RAM is required, a circuit that generates the clock needs to be provided, or the current consumption increases.

Also, a method is conceivable in which a first RAM for the vertical write mode and a second RAM for the horizontal write mode are provided, and the RAM to be accessed is switched based on the write mode. However, in this method, two types of RAMs need to be provided, and as a result, the area occupied by the RAMs increases.

SUMMARY

According to some aspects of the invention, storage devices, display drivers, electro-optical devices, electronic apparatuses, and the like can be provided in which a RAM can be accessed in a vertical write mode and a horizontal write mode without a conversion circuit or the like for display data being externally provided.

An aspect of the invention relates to a storage device including: a memory cell array into which monochrome display data is to be written; a write circuit configured to write the display data into the memory cell array; and a read circuit configured to read out the written display data from the memory cell array. The write circuit, in a first mode, writes a plurality of first pixel data units, each of the first pixel data units being constituted by data for pixels that are on the same data line and on different scan lines in a display panel, into a plurality of memory cells connected to a selected word line, and in a second mode, writes a plurality of second pixel data units, each of the second pixel data units being constituted by data for pixels that are on the same scan line and on different data lines in the display panel, into a plurality of memory cells connected to a selected word line.

According to the aspect of the invention, in the first mode, the first pixel data unit that is constituted by data for pixels that are on the same data line and on different scan lines in the display panel is written into the memory cell array, and in the second mode, the second pixel data unit that is constituted by data for pixels that are on the same scan line and on different data lines in the display panel is written into the memory cell array. Accordingly, a write operation to the RAM in the vertical write mode and the horizontal write mode is possible without converting the display data, and access to the RAM in the vertical and horizontal write modes can be realized without externally providing a conversion circuit or the like for the display data.

Also, in an aspect of the invention, the read circuit may be configured to, in the first mode, select and read out data for pixels that are on the same scan line from the plurality of first pixel data units.

In this way, data for the pixels that are on the same scan line can be selected and read out from the memory cell array into which the first pixel data unit constituted by data for the pixels on the same data line is written in the vertical write mode. That is, by performing such a read operation, writing into the RAM and reading out from the RAM can be made possible in the two modes without converting the display data.

Also, in an aspect of the invention, the read circuit may be configured to receive a mode setting signal of the first mode or the second mode, and the read circuit may be configured to, in a case where the first mode is set based on the mode setting signal, perform first bit line selection processing in which data for pixels that are on the same scan line is selected from the plurality of first pixel data units, and in a case where the second mode is selected based on the mode setting signal, perform second bit line selection processing in which pixel data that is the second pixel data unit is selected.

In this way, the display data can be read out with bit line selection processing according to the arrangement of the display data that has been written in either of the modes. That is, in the vertical write mode in which the first pixel data unit constituted by data for the pixels on the same data line is written, the pixel data can be selected and read out from the plurality of first pixel data units, and in the horizontal write mode in which the second pixel data unit constituted by data for the pixels on the same scan line is written, the pixel data of the second pixel data unit can be selected and read out.

Also, in an aspect of the invention, the read circuit may include: a column address decoder; a first column selection circuit configured to receive an output signal of the column address decoder and the mode setting signal, and perform the first bit line selection processing for the first mode; and a second column selection circuit configured to receive the output signal of the column address decoder and the mode setting signal, and perform the second bit line selection processing for the second mode.

In this way, in the case where the first mode is set based on the mode setting signal, the first column selection circuit can perform the first bit line selection processing, and in the case where the second mode is set based on the mode setting signal, the second column selection circuit can perform the second bit line selection processing. Accordingly, the read operation according to the mode setting can be realized.

Also, in an aspect of the invention, the read circuit may include a plurality of sense amplifier units each configured to amplify a read signal from the memory cell array, and each of the plurality of sense amplifier units includes a first output line for the first mode and a second output line for the second mode.

In this way, a read signal can be output to the first output line in the vertical write mode, and a read signal can be output to the second output line in the horizontal write mode. By providing output lines for the two modes in the sense amplifier unit, as described above, reading out from the memory cell array can be made possible in the vertical write mode and the horizontal write mode, the bit line selection processing being different between the two modes.

Also, in an aspect of the invention, the read circuit may include: a first bus constituted by a plurality of the first output lines; a second bus constituted by a plurality of the second output lines; and a selector configured to select the first bus in the first mode, and select the second bus in the second mode.

In this way, in the vertical write mode, read signals are output to the first output lines, and the first bus constituted by the first output lines is selected by the selector, and as a result the read signals of the first output lines can be output as the RAM output. On the other hand, in the horizontal write mode, read signals are output to the second output lines, the second bus constituted by the second output lines is selected by the selector, and as a result the read signals of the second output lines can be output as the RAM output.

Also, another aspect of the invention relates to a display driver including: any of the above-described storage devices; and a drive circuit configured to drive the display panel based on the display data that is read out from the storage device.

Also, another aspect of the invention relates to an electro-optical device including: the above-described display driver; and the display panel.

Also, another aspect of the invention relates to an electronic apparatus including any of the above-described storage devices.

BRIEF DESCRIPTION OF THE DRAWINGS

The invention will be described with reference to the accompanying drawings, wherein like numbers reference like elements.

FIG. 4 is a diagram illustrating correspondence between cells in a memory cell array and pixels in the display panel in the vertical write mode.

FIG. 6 is a diagram illustrating correspondence between cells in a memory cell array and pixels in the display panel in the horizontal write mode.

DESCRIPTION OF EXEMPLARY EMBODIMENTS

Hereinafter, a preferable embodiment of the invention will be described in detail. Note that the embodiment described below is not intended to unduly limit the content of the invention described in the scope of claims, and not all configurations described in this embodiment are necessarily essential as solving means of the invention.

1. Driver and Storage Device

Figure 1:
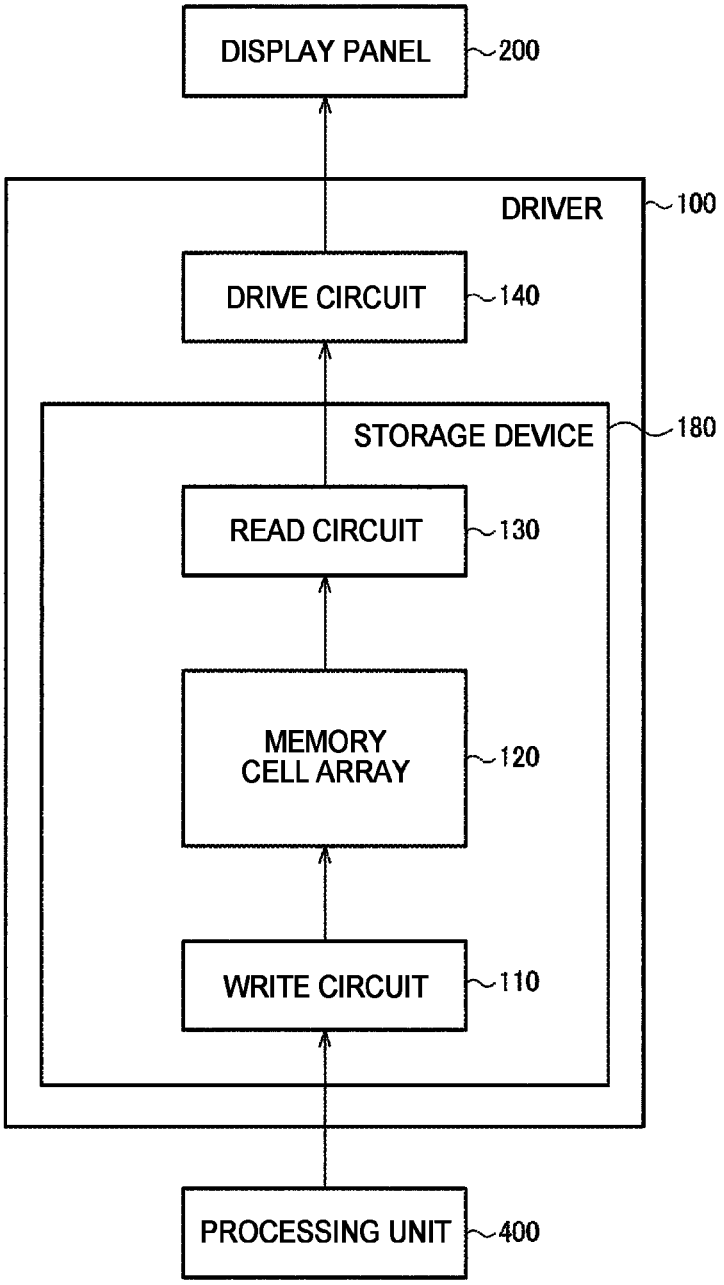
FIG. 1 shows an exemplary configuration of a driver and a storage device.

An exemplary configuration of a driver and a storage device in this embodiment is shown in FIG. 1. A driver 100 includes a storage device 180 and a drive circuit 140 that drives a display panel 200 based on the display data read out from the storage device 180. The storage device 180 includes a memory cell array 120 into which monochrome display data is written, a write circuit 110 that writes display data into the memory cell array 120, and a read circuit 130 that reads out the written display data from the memory cell array 120.

Hereinafter, memory access in a vertical write mode (first mode) and a horizontal write mode (second mode) that is performed by the storage device 180 will be described. Note that the number of pixels of the display panel 200 is assumed to be 120×320=38400, and the number of cells of the memory cell array 120 is assumed to be 64×600=38400, but the number of pixels and the number of cells are arbitrary.

Figure 2:
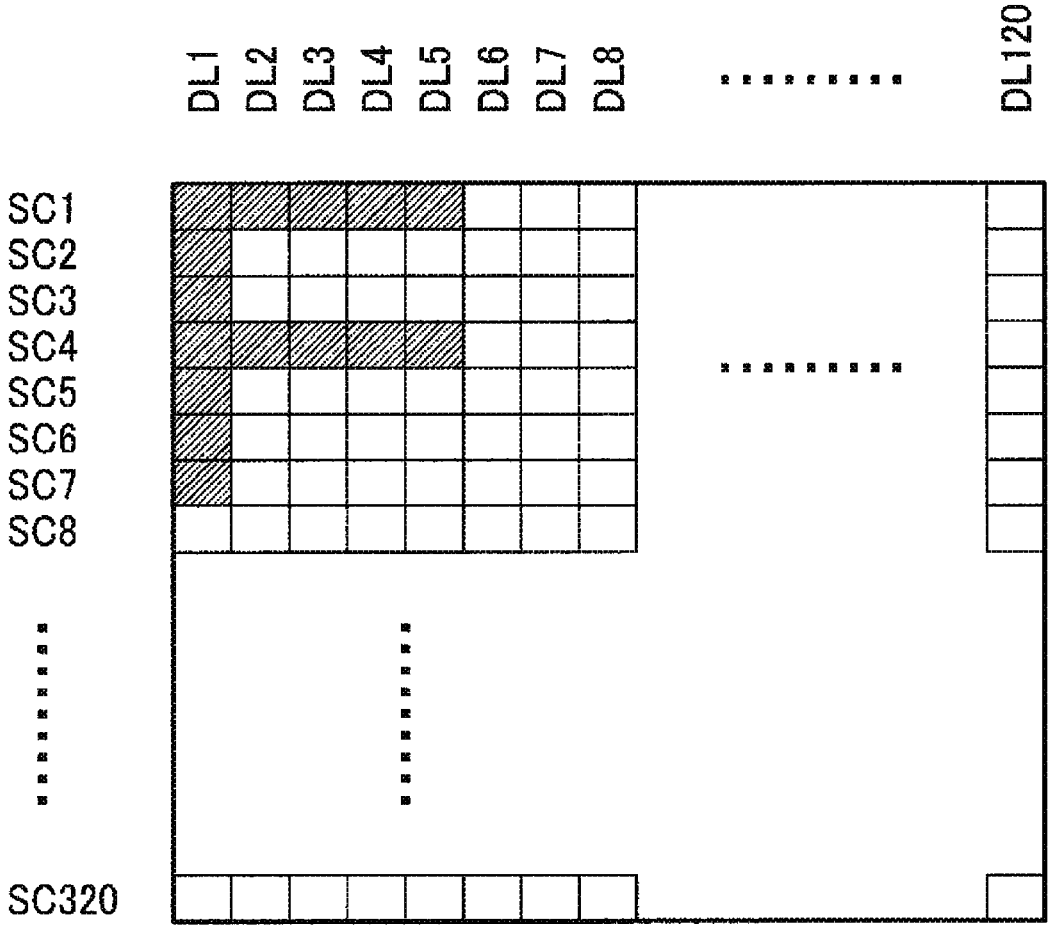
FIG. 2 shows an example of display data that is displayed in a display panel.

An example of display data that is displayed in the display panel 200 is shown in FIG. 2. The display panel 200 is, for example, a liquid crystal display panel (such as an active matrix type), an EL (Electro-Luminescence) display panel, or the like. In FIG. 2, data lines DL1 to DL120 (source lines) are laid out along a vertical direction, and scan lines SC1 to SC320 (gate lines) are laid out along a horizontal direction. Pixels are connected to respective intersections of the data lines and the scan lines. A pixel connected to a scan line SC1 and a data line DL1 is denoted by SC1/DL1, for example. In FIG. 2, a letter "F" is displayed in a region of 8×8 pixels, which are pixels SC1/DL1 to SC8/DL8, hatched pixels represent display data "1", for example, and white pixels represent display data "0", for example. The display data is binary monochrome display data. The binary monochrome display data need not be black and white. For example, the binary monochrome display data can be white and red.

Figure 3:
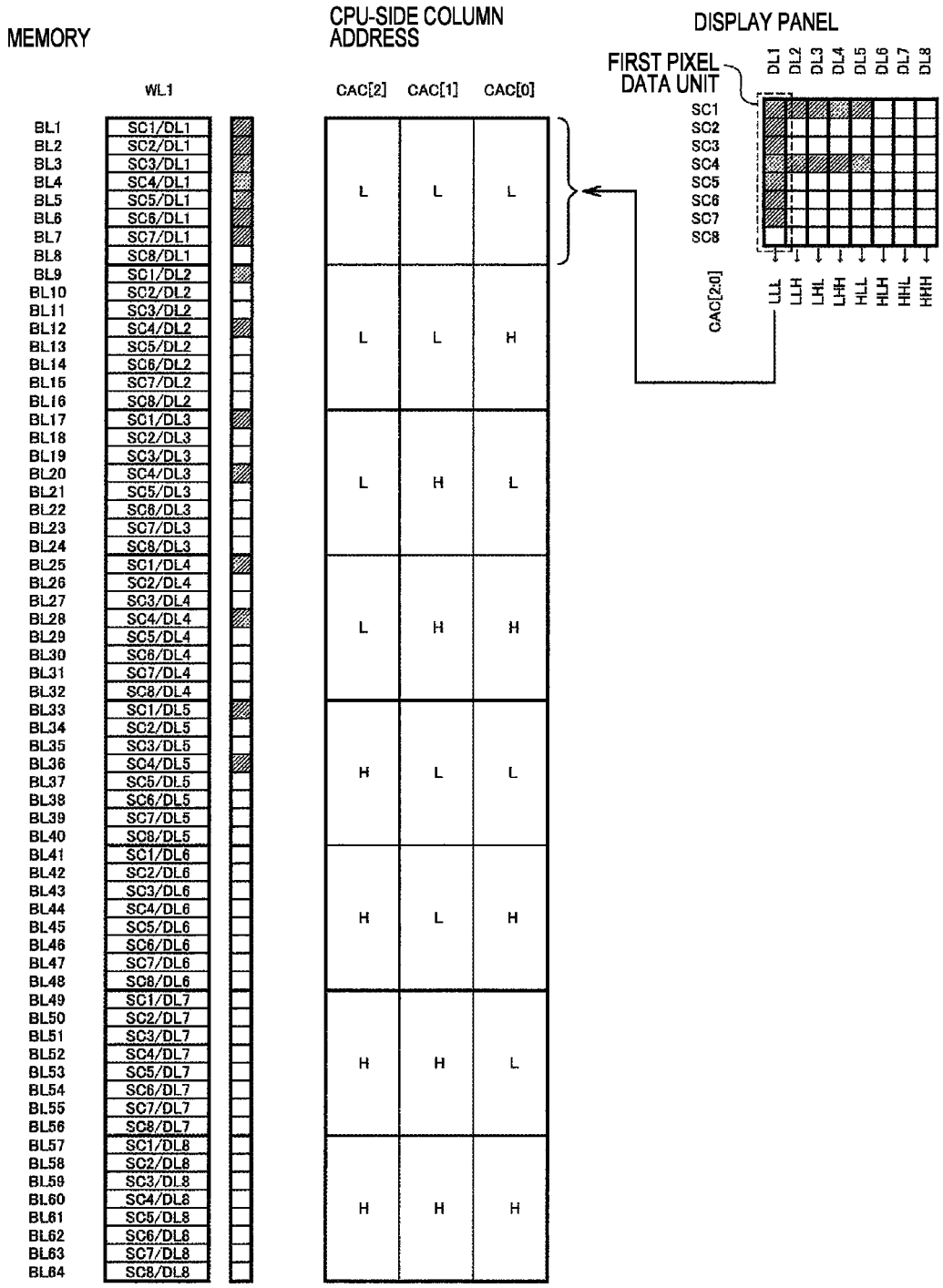
FIG. 3 is a diagram for describing a write operation in a vertical write mode.

A diagram for describing a write operation in the vertical write mode is shown in FIG. 3. In FIG. 3, a description is given with respect to a region of 8×8 pixels (SC1/DL1 to SC8/DL8) in the display panel, as an example. Note that a cell connected to a word line WL1 and a bit line BL1 will be denoted by WL1/BL1 in the memory cell array 120, for example.

Display data is transferred to the write circuit 110 from an external processing unit 400 (such as a CPU or a display controller), and the write circuit 110 writes the display data into the memory cell array 120. As shown in FIG. 3, the display data for the pixels SC1/DL1 to SC8/DL8 in the display panel 200 is written into 64×1 cells of cells WL1/BL1 to WL1/BL64 in the memory cell array 120.

In the vertical write mode, 8 pixels on the same data line in the display panel 200 constitute a data unit in memory write. For example, the write circuit 110 selects a write column address (CPU-side column address) CAC[2:0]=LLL for the display data of the pixels SC1/DL1 to SC8/DL1 on the data line DL1. Write buffers of the bit lines BL1 to BL8 are selected by decoding this column address, and display data of pixels SC1/DL1 to SC8/DL1 is written into the memory cells WL1/BL1 to WL1/BL8.

Correspondence between cells in the memory cell array and pixels in the display panel in the vertical write mode is shown in FIG. 4. The memory cell array 120 is constituted by a RAM such as an SRAM (Static Random Access Memory), for example. In FIG. 4, word lines WL1 to WL600 are laid out along a vertical direction, and bit lines BL1 to BL64 are laid out along a horizontal direction. Memory cells are connected to the respective intersections of the word lines and the bit lines. In the case of monochrome display data in which display data for one pixel is one bit, the display data for one pixel is stored in one memory cell.

Display data for one screen of the display panel 200 is written into the memory cell array 120 in the following manner, for example.

First, display data for the pixels SC1/DL1 to SC8/DL1 on the data line DL1 in the display panel 200 is written into the memory cells WL1/BL1 to WL1/BL8 on the word line WL1 in the memory cell array 120. Next, display data for the pixels SC1/DL2 to SC8/DL2 on the data line DL2 is written into the memory cells WL1/BL9 to WL1/BL16 on the word line WL1. By repeating this operation, display data for the pixels SC1/DL8 to SC8/DL8 on the data line DL8 is written into the memory cells WL1/BL57 to WL1/BL64 on the word line WL1, and the write operation to the cells on the word line WL1 is completed.

Next, in a similar manner, display data for the pixels on data lines DL9 to DL16 is written into cells on the word line WL2. That is, display data for the pixels SC1/DL9 to SC8/DL9, SC1/DL10 to SC8/DL10, SC1/DL16 to SC8/DL16 is written into cells WL2/BL1 to WL2/BL8, WL2/BL9 to WL2/BL16, WL2/BL57 to WL2/BL64. Next, this operation is repeated up to the word line WL15, and the display data for all the pixels on the scan lines SC1 to SC8 is written into the memory cell array 120.

Next, in a similar manner, display data for the pixels on scan lines SC9 to SC16 is written into cells on word lines WL16 to WL30. By repeating this operation, display data for pixels on scan lines SC313 to SC320 is written into cells on word lines WL586 to WL600, and the write operation of the display data of one screen is completed.

Figure 5:
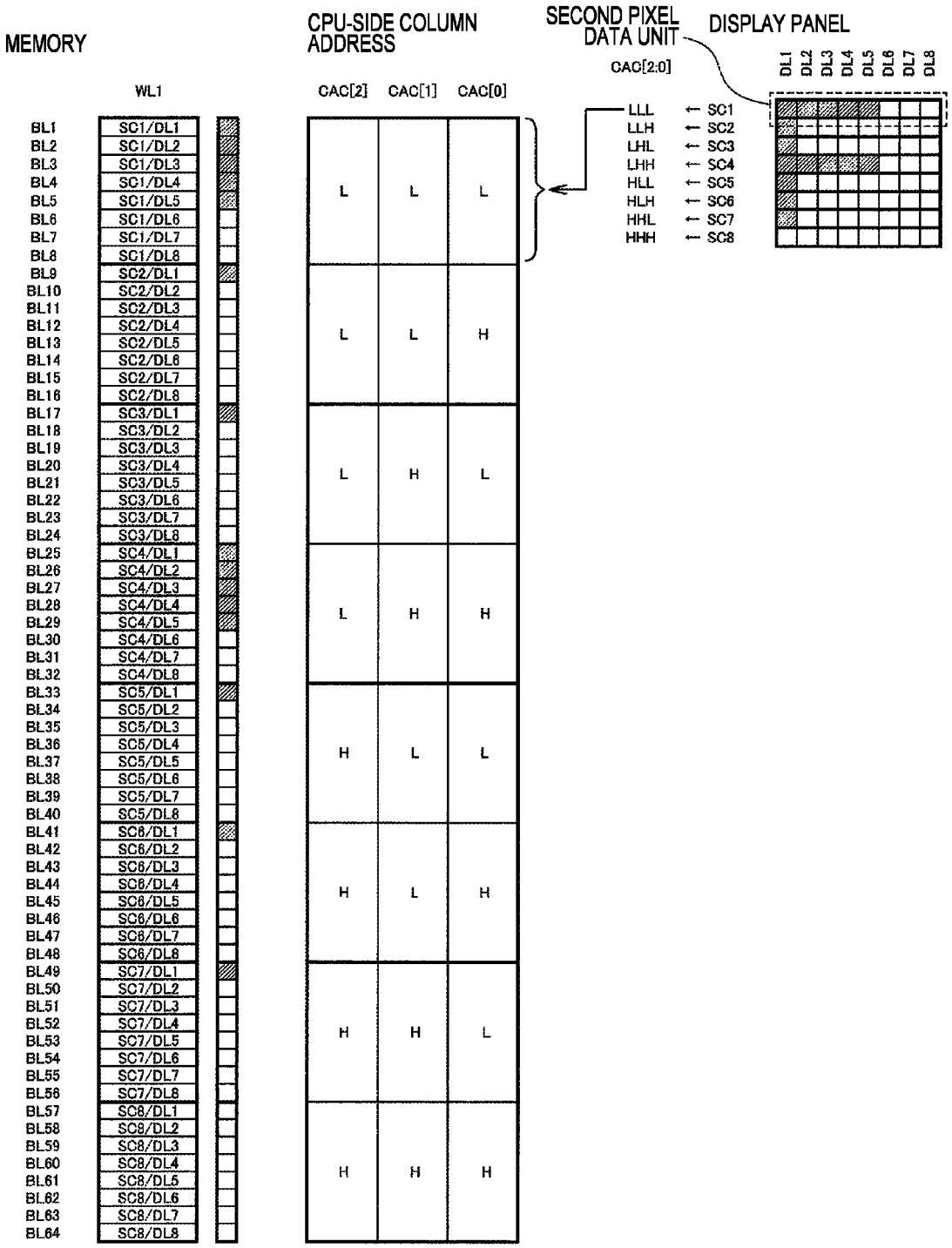
FIG. 5 is a diagram for describing a write operation in a horizontal write mode.

FIG. 5 is a diagram for describing a write operation in a horizontal write mode. In FIG. 5, a description is given with respect to a region of 8×8 pixels (SC1/DL1 to SC8/DL8) in the display panel, as an example.

In the horizontal write mode, 8 pixels on the same scan line in the display panel 200 constitute a data unit in memory write. For example, the write circuit 110 selects a write column address (CPU-side column address) CAC[2:0]=LLL for the display data of the pixels SC1/DL1 to SC1/DL8 on the scan line SC1. Write buffers of the bit lines BL1 to BL8 are selected by decoding this column address, and display data of pixels SC1/DL1 to SC1/DL8 is written into the memory cells WL1/BL1 to WL1/BL8.

Correspondence between cells in the memory cell array and pixels in the display panel in the horizontal write mode is shown in FIG. 6. Display data of one screen of the display panel 200 is written into the memory cell array 120 in the following manner, for example.

First, display data for the pixels SC1/DL1 to SC1/DL8 on the scan line SC1 in the display panel 200 is written into the cells WL1/BL1 to WL1/BL8 on the word line WL1 in the memory cell array 120. Next, display data for the pixels SC1/DL9 to SC1/DL16 on the scan line SC1 is written into the cells WL2/BL1 to WL2/BL8 on the word line WL2. By repeating this operation, display data for the pixels SC1/DL113 to SC1/DL120 on the scan line SC1 is written into the cells WL15/BL1 to WL15/BL8 on the word line WL15, and the write operation of the display data for the pixels on the scan line SC1 is completed.

Next, in a similar manner, display data for the pixels on the scan line SC2 is written into the cells on the bit lines BL9 to BL16. That is, display data for the pixels SC2/DL1 to SC2/DL8, SC2/DL9 to SC2/DL16, . . . , SC2/DL113 to SC2/DL120 is written into the cells WL1/BL9 to WL1/BL16, WL2/BL9 to WL2/BL16, . . . , WL15/BL9 to WL15/BL16. Next, this operation is repeated up to the scan line SC8, and display data for all the pixels on scan lines SC1 to SC8 is written into the memory cell array 120.

Next, in a similar manner, display data for the pixels on the scan lines SC9 to SC16 is written into the cells on the word lines WL16 to WL30. By repeating this operation, display data for the pixels on the scan lines SC313 to SC320 is written into the cells on the word lines WL586 to WL600, and the write operation of the display data of one screen is completed.

As described above, the correspondence relationship between cells in the memory cell array 120 and pixels in the display panel 200 is different between the vertical write mode and the horizontal write mode. Therefore, in order to make a storage device designed for one mode to support the other mode, data conversion needs to be performed.

For example, in order to make a storage device in which memory access is performed in the horizontal write mode support the vertical write mode, the display data in the vertical write mode needs to be converted into display data in the horizontal write mode before being written into the memory cell array 120. In this case, data units in the vertical (data line) direction are sequentially input as the input data, namely 8 bits on the data line DL1, 8 bits on the data line DL2, and so on, as shown in FIG. 3. On the other hand, the write data to the memory cell array 120 is constituted by data units in the horizontal (scan line) direction, namely 8 bits on the scan line SC1, 8 bits on the scan line SC2, and so on, as shown in FIG. 5. Therefore, it is necessary that eight data units (8×8 pixels) are temporarily read into, and data units in the horizontal direction are read out and written into the memory cell array 120.

In this regard, according to this embodiment, the write circuit 110 writes a plurality of first pixel data units in the first mode (vertical write mode). Each first pixel data unit is constituted by data for pixels (pixels SC1/DL1 to SC8/DL1, for example) that are on the same data line and on different scan lines in the display panel 200, the data for the pixels being written into a plurality of memory cells (cells WL1/

BL1 to WL1/BL8, for example) that are connected to a selected word line (WL1, for example). On the other hand, in the second mode (horizontal write mode) a plurality of second pixel data units are written. Each second pixel data unit is constituted by data for pixels (pixels SC1/DL1 to SC1/DL8, for example) that are on the same scan line and on different data lines in the display panel 200, the data for the pixels being written into a plurality of memory cells (cells WL1/BL1 to WL1/BL8, for example) that are connected to a selected word line (WL1, for example).

Here, the first pixel data unit is a data unit that is written into the memory cell array 120 in one write operation in the vertical write mode. Data for the pixels SC1/DL1 to SC8/DL1, SC1/DL2 to SC8/DL2, SC1/DL3 to SC8/DL3, and the like, in FIGS. 3 and 4, is the first pixel data unit. The second pixel data unit is a data unit that is written into the memory cell array 120 in one write operation in the horizontal write mode. Data for the pixels SC1/DL1 to SC1/DL8, SC2/DL1 to SC2/DL8, SC3/DL1 to SC3/DL8, and the like, in FIGS. 5 and 6, is the second pixel data unit.

In this way, in this embodiment, memory write is possible in either the vertical write mode or the horizontal write mode without converting data between the two modes, and as a result memory access in each mode is enabled and a circuit can be simplified by omitting a data conversion circuit. More specifically, in a read operation from the memory cell array 120, memory access in the two modes is realized by changing cells from which data is read out between the vertical write mode and the horizontal write mode (decoding of a column address is changed).

Figure 7:
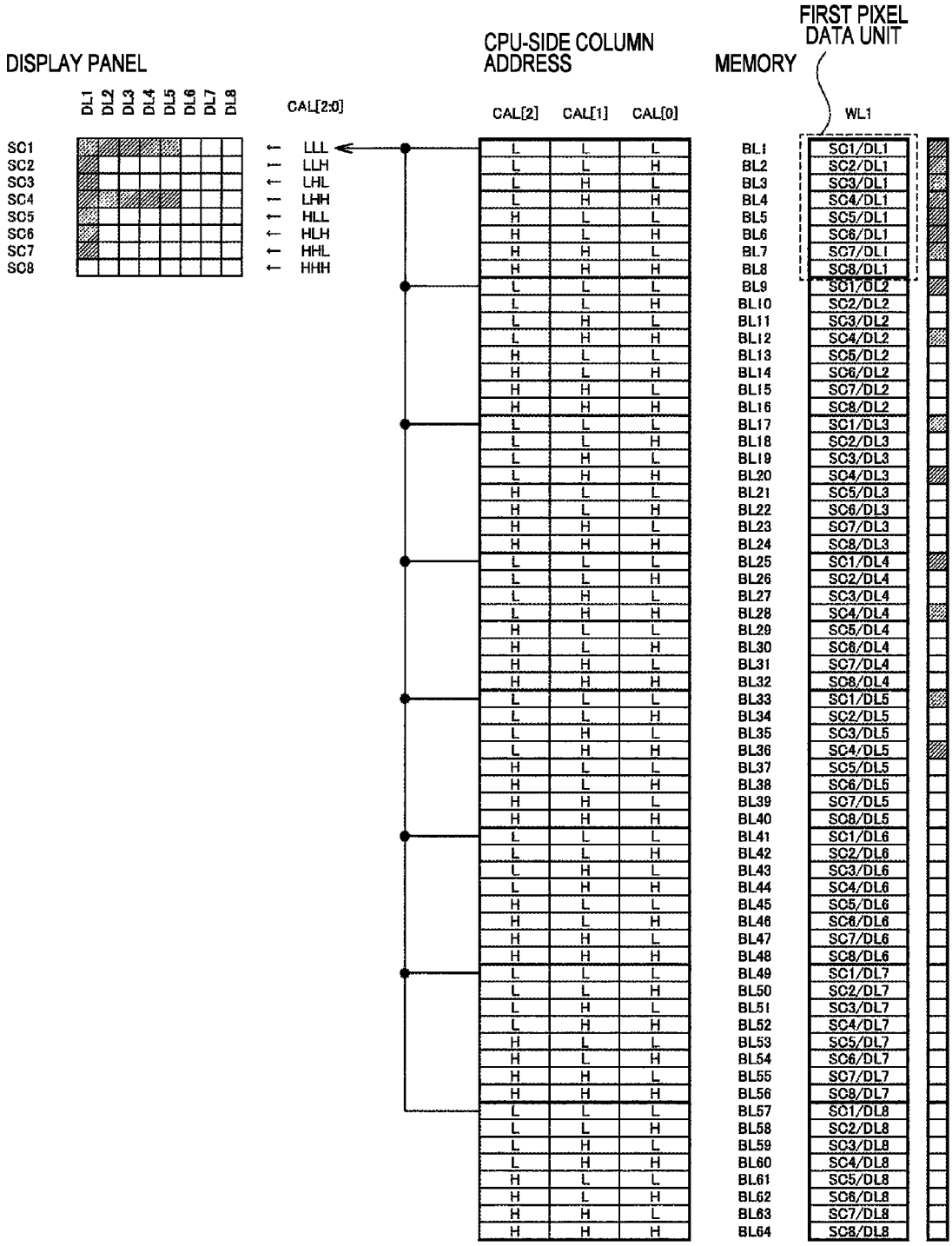
FIG. 7 is a diagram for describing a read operation in the vertical write mode.

Hereinafter, read operations in the vertical write mode and the horizontal write mode will be described. A diagram for describing a read operation in the vertical write mode is shown in FIG. 7. In FIG. 7, a description is given with respect to a region of 8×8 pixels (SC1/DL1 to SC8/DL8) in the display panel 200, as an example.

The read circuit 130 sequentially reads out display data from the memory cell array 120, and outputs the display data to the drive circuit 140. The drive circuit 140 performs D/A conversion on the display data to drive voltages, and drives pixels (data line) in the display panel 200 with the drive voltages.

Because pixel driving is performed in units of scan lines, display data for the pixels on the same scan line needs to be read out from the memory cell array 120. In the vertical write mode, since data for 8 pixels on the same data line is written into the memory cell array 120 as a data unit, display data is read out from different data units. For example, the read circuit 130 selects a read column address (panel-side column address) CAL[2:0]=LLL. Sense amplifiers connected to the bit lines BL1, BL9, BL17, . . . , BL57 are selected by decoding this column address, and display data for the pixels SC1/DL1 to SC1/DL8 on the scan line SC1 is read out from the cells WL1/BL1, WL1/BL9, WL1/BL17, . . . , WL1/BL57.

Display data of one screen in the display panel 200 is read out from the memory cell array 120 in the following manner, for example.

First, display data for the pixels SC1/DL1 to SC1/DL8 on the scan line SC1 in the display panel 200 is read out from the cells WL1/BL1, WL1/BL9, WL1/BL17, . . . , WL1/BL57 on the word line WL1 in the memory cell array 120. Next, display data for the pixels SC1/DL9 to SC1/DL16 on the same scan line SC1 is read out from the cells WL2/BL1, WL2/BL9, WL2/BL17, . . . , WL2/BL57 on the word line WL2. By repeating this operation, display data for the pixels SC1/DL113 to SC1/DL120 on the scan line SC1 is read out from the cells WL15/BL1, WL15/BL9, WL15/BL17, . . . , WL15/BL57 on the word line WL15, and readout of the display data for the pixels on the scan line SC1 is completed.

Next, display data for the pixels on the scan line SC2 is read out from the cells on the bit lines BL2, BL10, BL18, . . . , BL58 on the word lines WL1 to WL15 in a similar manner. This operation is repeated up to the scan line SC8, and display data for all the pixels on the scans line SC1 to SC8 is read out.

Next, display data for the pixels on the scan lines SC9 to SC16 is read out from the cells on the word lines WL16 to WL30 in a similar manner. By repeating this operation, display data for the pixels on the scan lines SC313 to SC320 is read out from the cells on the word lines WL586 to WL600, and readout of the display data of one screen is completed.

Figure 8:
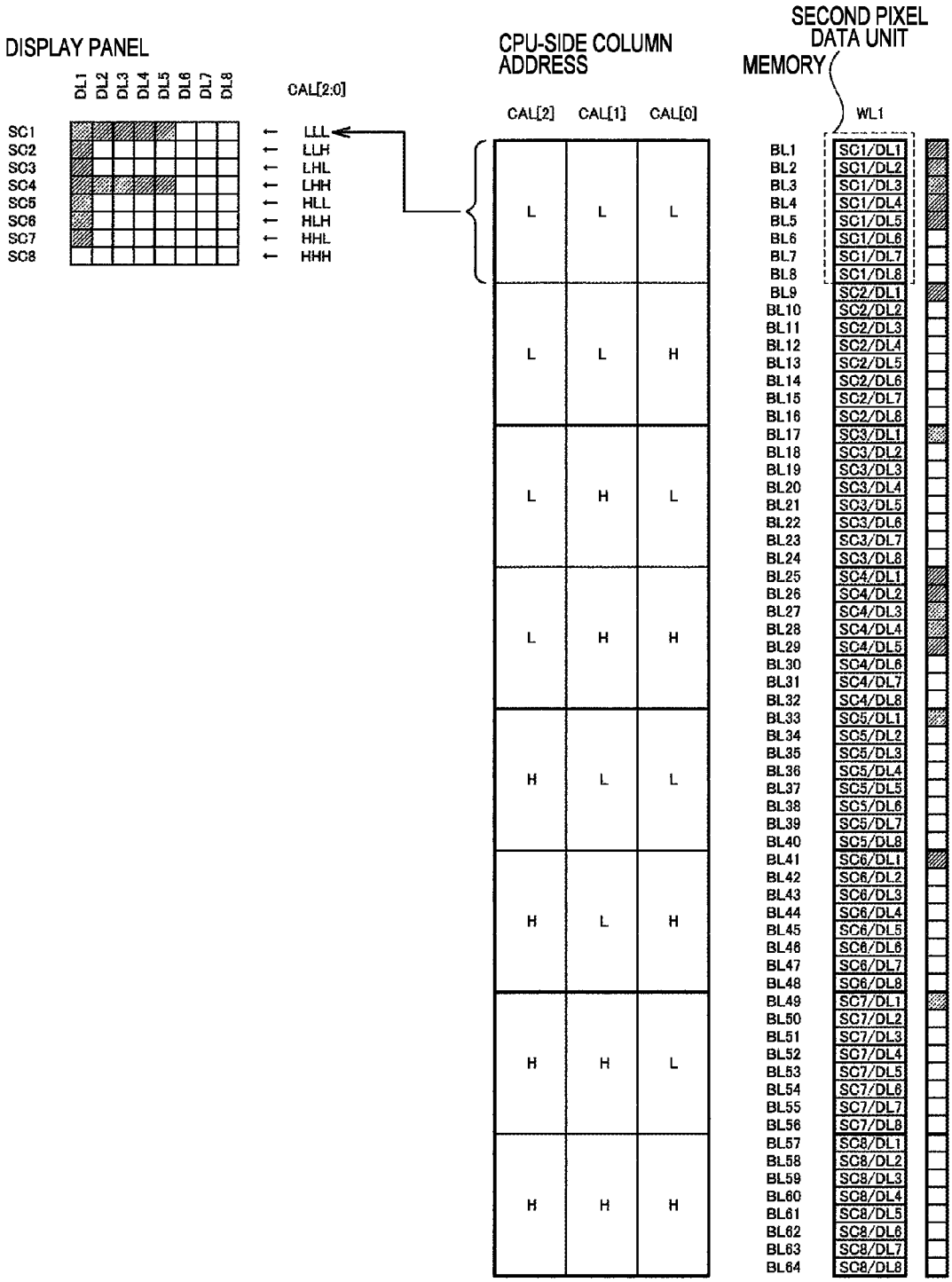
FIG. 8 is a diagram for describing a read operation in the horizontal write mode.

FIG. 8 is a diagram for describing a read operation in the horizontal write mode. In FIG. 8, a description is given with respect to a region of 8×8 pixels (SC1/DL1 to SC8/DL8) in the display panel, as an example.

In the horizontal write mode, since data for 8 pixels on the same scan line is written into the memory cell array 120 as a data unit, the data unit is read out as display data. For example, the read circuit 130 selects a read column address (panel-side column address) CAL[2:0]=LLL. Sense amplifiers connected to the bit lines BL1 to BL8 are selected by decoding this column address, and display data for the pixels SC1/DL1 to SC1/DL8 on the scan line SC1 is read out from the cells WL1/BL1 to WL1/BL8.

Compared with the vertical write mode shown in FIG. 7, although the same column address CAL[2:0]=LLL is designated when data for the pixels SC1/DL1 to SC1/DL8 is to be read out, the selected bit lines are different. In this way, by changing the decoding scheme for the column address depending on the mode, memory access in the two modes can be realized. Also, because the same column address (logical address) is designated for the display data for the same 8 pixels, the storage device 180 operates in the same logic in the two modes when viewed from the outside, and the same control can be applied to the logical units outside the storage device 180 independent of the modes.

Display data of one screen for the display panel 200 in the horizontal write mode is read out from the memory cell array 120 in the following manner, for example.

First, display data for the pixels SC1/DL1 to SC1/DL8 on the scan line SC1 in the display panel 200 is read out from the cells WL1/BL1 to WL1/BL8 on the word line WL1 in the memory cell array 120. Next, display data for the pixels SC1/DL9 to SC1/DL16 on the same scan line SC1 is read out from the cells WL2/BL1 to WL2/BL8 on the word line WL2. By repeating this operation, display data for the pixels SC1/DL113 to SC1/DL120 on the scan line SC1 is read out from the cells WL15/BL1 to WL15/BL8 on the word line WL15, and the readout of the display data for the scan line SC1 is completed.

Next, display data for the scan line SC2 is read out from the cells that are on the bit lines BL9 to BL16 and on the word lines WL1 to WL15 in a similar manner. By repeating this operation up to the scan line SC8, the display data for all the pixels on the scan lines SC1 to SC8 is read out.

Next, display data for the pixels on the scan lines SC9 to SC16 is read out from the cells on the word lines WL16 to WL30 in a similar manner. By repeating this operation, display data for the pixels on the scan lines SC313 to SC320 is read out from the cells on the word lines WL586 to WL600, and the readout of the display data of one screen is completed.

According to this embodiment described above, the read circuit 130 selects and reads out data for the pixels on the same scan line from the plurality of first pixel data units (pixels SC1/DL1 to SC1/DL8 from the cells WL1/BL1, WL1/BL9, WL1/BL17, . . . , WL1/BL57, for example) in the first mode (vertical write mode).

In this way, the pixel data for display driving of the display panel 200 while scanning the scan lines can be read out from the memory cell array 120 into which data is written in the vertical write mode (first pixel data units that each are constituted by data for the pixels on the same data line). By using such a readout method in the vertical write mode, memory access that does not require data conversion in either the vertical write mode or the horizontal write mode can be realized.

More specifically, the read circuit 130 receives a mode setting signal of the first mode or the second mode. In the case where the first mode (vertical write mode) is set based on the mode setting signal, first bit line selection processing in which data for the pixels on the same scan line is selected from the plurality of first pixel data units is performed. On the other hand, in the case where the second mode (horizontal write mode) is set based on the mode setting signal, second bit line selection processing in which pixel data in the second pixel data unit is selected (pixels SC1/DL1 to SC1/DL8 from cells WL1/BL1 to WL1/BL8, for example) is performed.

The mode setting signal may be input from a terminal of a driver 100 IC (pin setting), for example. Alternatively, the mode setting signal may be written into an unshown register unit of the driver 100 from the processing unit 400 as a register value.

In this way, the mode is switched between the vertical write mode and the horizontal write mode based on the mode setting signal, and display data is read out from the memory cell array 120 with the bit line selection processing based on the mode, and as a result readout of the display data that is written in either of the modes (correspondence relationship between the pixels and the cells is different) can be read out in an arrangement and sequence adapted to the driving sequence.

2. Detailed Configuration of Driver

Figure 9:
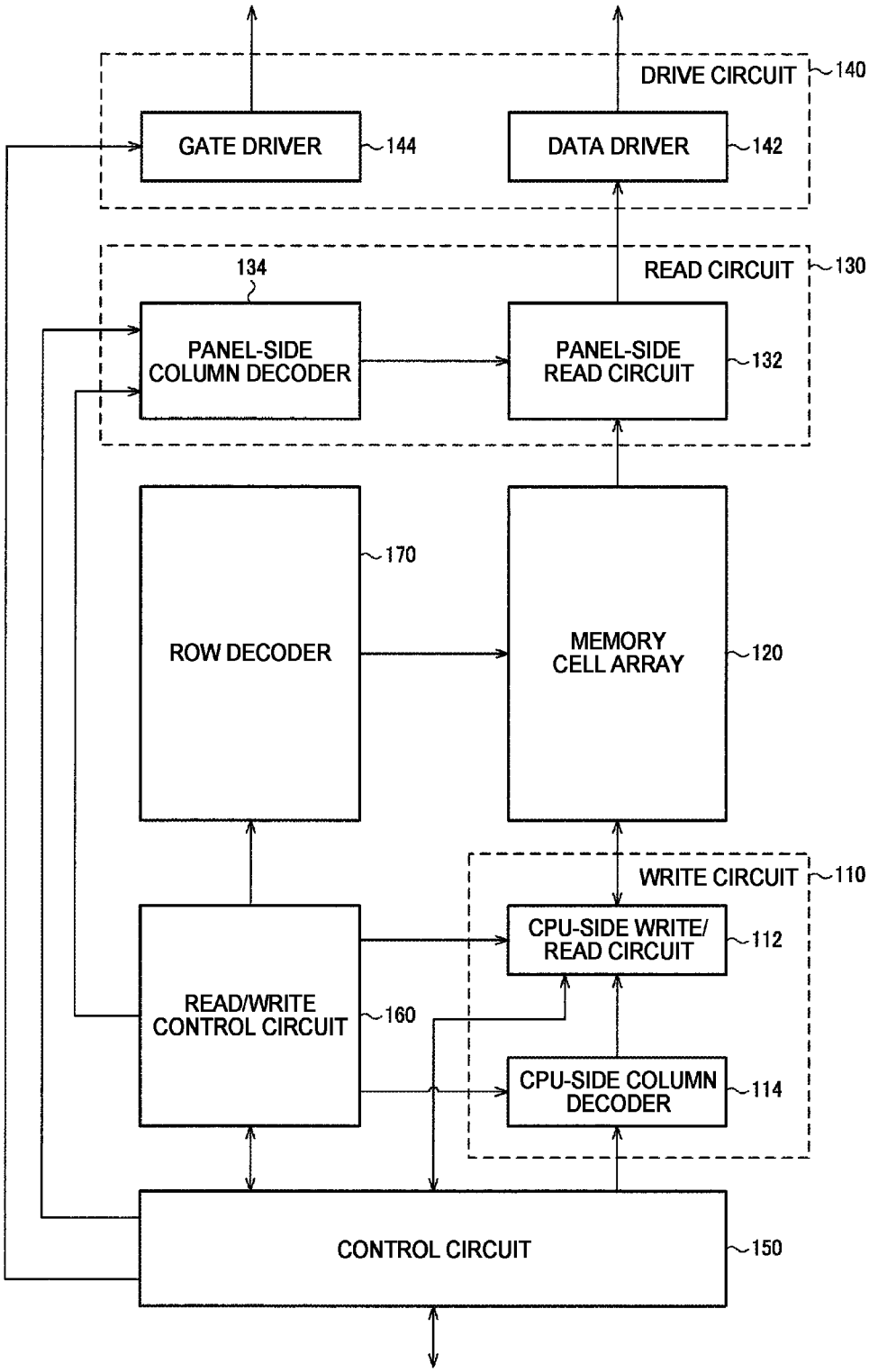
FIG. 9 shows a detailed exemplary configuration of the driver.

Hereinafter, a detailed configuration in which the memory access described above is performed will be described. A detailed exemplary configuration of the driver 100 is shown in FIG. 9. The driver 100 includes the write circuit 110, the memory cell array 120, the read circuit 130, the drive circuit 140, a control circuit 150, a read/write control circuit 160, and a row decoder 170. The driver 100 is configured as an integrated circuit device, for example.

The control circuit 150 performs processing regarding an interface with an external processing unit 400, and controls the units of the driver 100. For example, the control circuit 150 transfers display data to the read/write control circuit 160, transfers display data that is read out by the read/write control circuit 160 to the processing unit 400, supplies a column address to the write circuit 110 or the read circuit 130, supplies the mode setting signal to the read circuit 130, controls a drive timing, and the like.

The read/write control circuit 160 controls access to the memory cell array 120. For example, the read/write control circuit 160 controls write timing and read timing, controls ports (CPU-side port, panel-side port), supplies a row address based on write data to the row decoder 170, supplies a row address based on readout data to the row decoder 170, and the like.

The row decoder 170 performs decode processing in which a row address (logical address) is converted to a word line address (physical address) in the memory cell array 120. In a case where the number of word lines is 600, as shown in FIG. 4, the row address is designated by 10-bit data. A CPU-side port row address is designated when accessing the CPU-side port, and a panel-side port row address is designated when accessing the panel-side port.

The write circuit 110 includes a CPU-side write/read circuit 112 and a CPU-side column decoder 114. The CPU-side column decoder 114 performs decode processing in which a CPU-side column address CAC[2:0] (logical address) is associated with a bit line address (physical address) in the memory cell array 120. The CPU-side write/read circuit 112 writes data with a write buffer to bit lines selected by the CPU-side column decoder 114. The CPU-side write/read circuit 112 also reads out data with a sense amplifier from the selected bit lines. Although being referred to as the write circuit 110 in this embodiment, both the write operation and the read operation can be performed in this example.

The read circuit 130 includes a panel-side read circuit 132 and a panel-side column decoder 134. The panel-side column decoder 134 performs decode processing in which a panel-side column address CAL[2:0] (logical address) is converted to a bit line address (physical address) in the memory cell array 120. The panel-side read circuit 132 reads out data with a sense amplifier from bit lines selected by the panel-side column decoder 134. Here, a read operation is performed such that correspondence between column addresses and bit lines is different between the vertical write mode and the horizontal write mode.

The drive circuit 140 includes a data driver 142 (source driver) and a gate driver 144 (scan driver). The data driver 142 includes a tone voltage generation circuit, a D/A conversion circuit, and an amplifier circuit (source amplifier), for example. The D/A conversion circuit selects a voltage corresponding to the display data read out by the panel-side read circuit 132 from a plurality of voltages that are generated by the tone voltage generation circuit. The amplifier circuit amplifies the selected voltage and drives a data line in the display panel 200. The gate driver 144 includes a buffer circuit (gate buffer), for example. The buffer circuit drives (selects) a gate line in the display panel 200 based on the timing control by the control circuit 150.

3. Read Circuit

Figure 10:
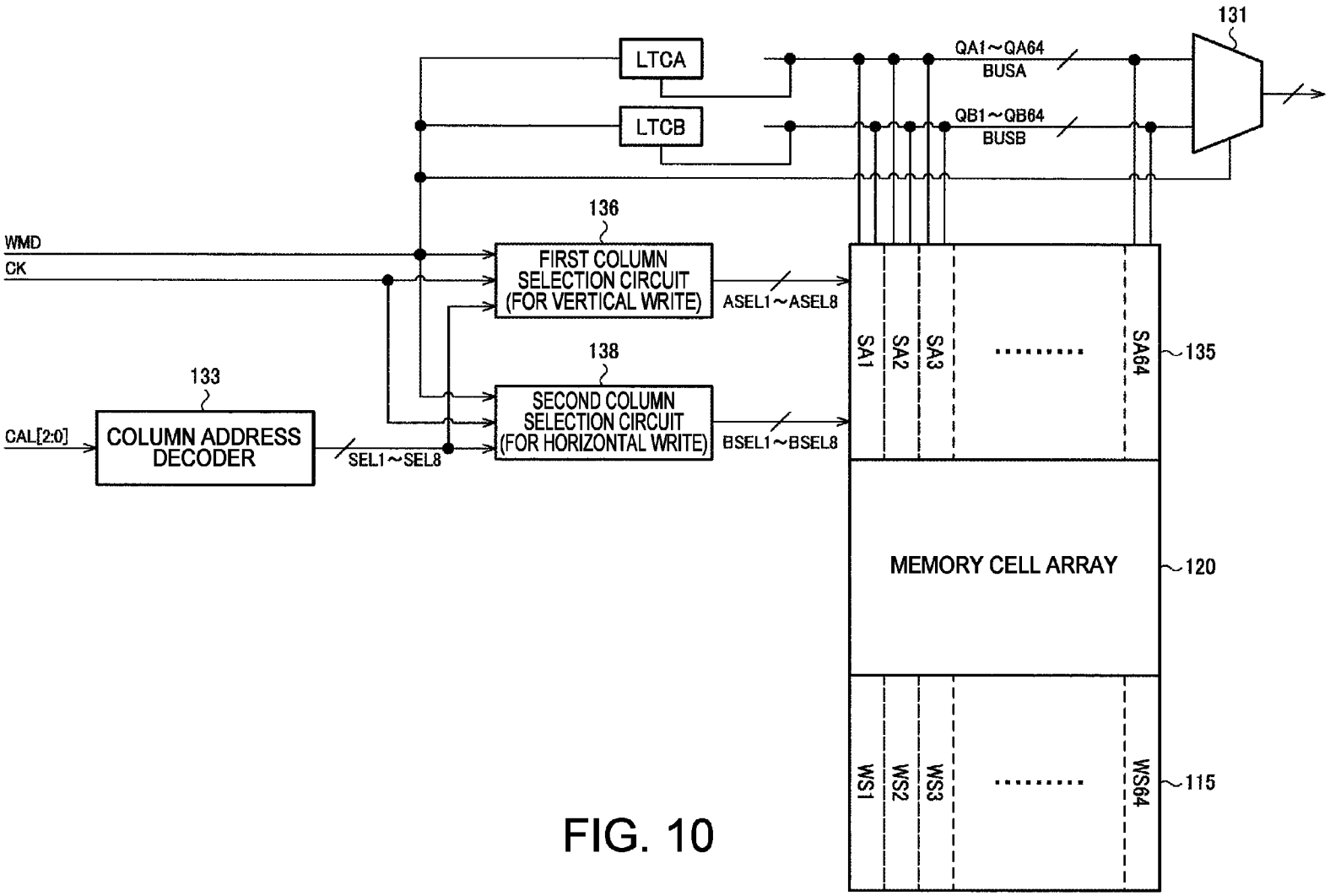
FIG. 10 shows a detailed exemplary configuration of a read circuit.

A detailed exemplary configuration of the read circuit 130 is shown in FIG. 10. The read circuit 130 includes a selector 131, a column address decoder 133, a sense amplifier group 135, a first column selection circuit 136 (column selection circuit for vertical write), a second column selection circuit 138 (column selection circuit for horizontal write), a first latch circuit LTCA, and a second latch circuit LTCB. The column address decoder 133, the first column selection circuit 136, and the second column selection circuit 138 correspond to the panel-side column decoder 134 shown in FIG. 9, and the sense amplifier group 135, the selector 131, the first latch circuit LTCA, and the second latch circuit LTCB correspond to the panel-side read circuit 132 shown in FIG. 9.

The sense amplifier group 135 includes sense amplifier units SA1 to SA64 (plurality of sense amplifier units) that are respectively provided in association with the bit lines BL1 to BL64. Each sense amplifier unit amplifies a read signal from a cell connected to the bit line associated with the sense amplifier, and reads out data stored in the cell.

Note that a write buffer/sense amplifier group 115 is provided on the CPU side as the CPU-side write/read circuit 112 shown in FIG. 9. The write buffer/sense amplifier group 115 includes write buffer/sense amplifier units WS1 to WS64 that are respectively in association with the bit lines BL1 to BL64. Each write buffer/sense amplifier unit includes a write buffer unit that writes data to a cell connected to a bit line that is associated with the write buffer/sense amplifier unit, and a sense amplifier unit that reads out data from a cell connected to a bit line that is associated with the write buffer/sense amplifier unit.

The first column selection circuit 136 receives output signals SEL1 to SEL8 from the column address decoder 133 and a mode setting signal WMD, and performs first bit line selection processing for the first mode (vertical write mode). The second column selection circuit 138 receives the output signals SEL1 to SEL8 from the column address decoder 133 and the mode setting signal WMD, and performs second bit line selection processing for the second mode (horizontal write mode).

Specifically, the column address decoder 133 outputs the output signals SEL1 to SEL8, one of which becomes active depending on the column address CAL[2:0]. That is, in the case where the column address CAL[2:0]=LLL is input, only the output signal SEL1 is activated (to a first logic level such as a high level), and the output signals SEL2 to SEL8 are deactivated (to a second logic level such as a low level). In the case where the column addresses CAL[2:0]=LLH, LHL, . . . , HHH are input, the output signals SEL2, SEL3, . . . , SEL8 are respectively activated.

The first column selection circuit 136 and the second column selection circuit 138 select bit lines (sense amplifiers) using the signals SEL1 to SEL8, and the first bit line selection processing and the second bit line selection processing are realized by the difference in the selection scheme.

Figure 11:
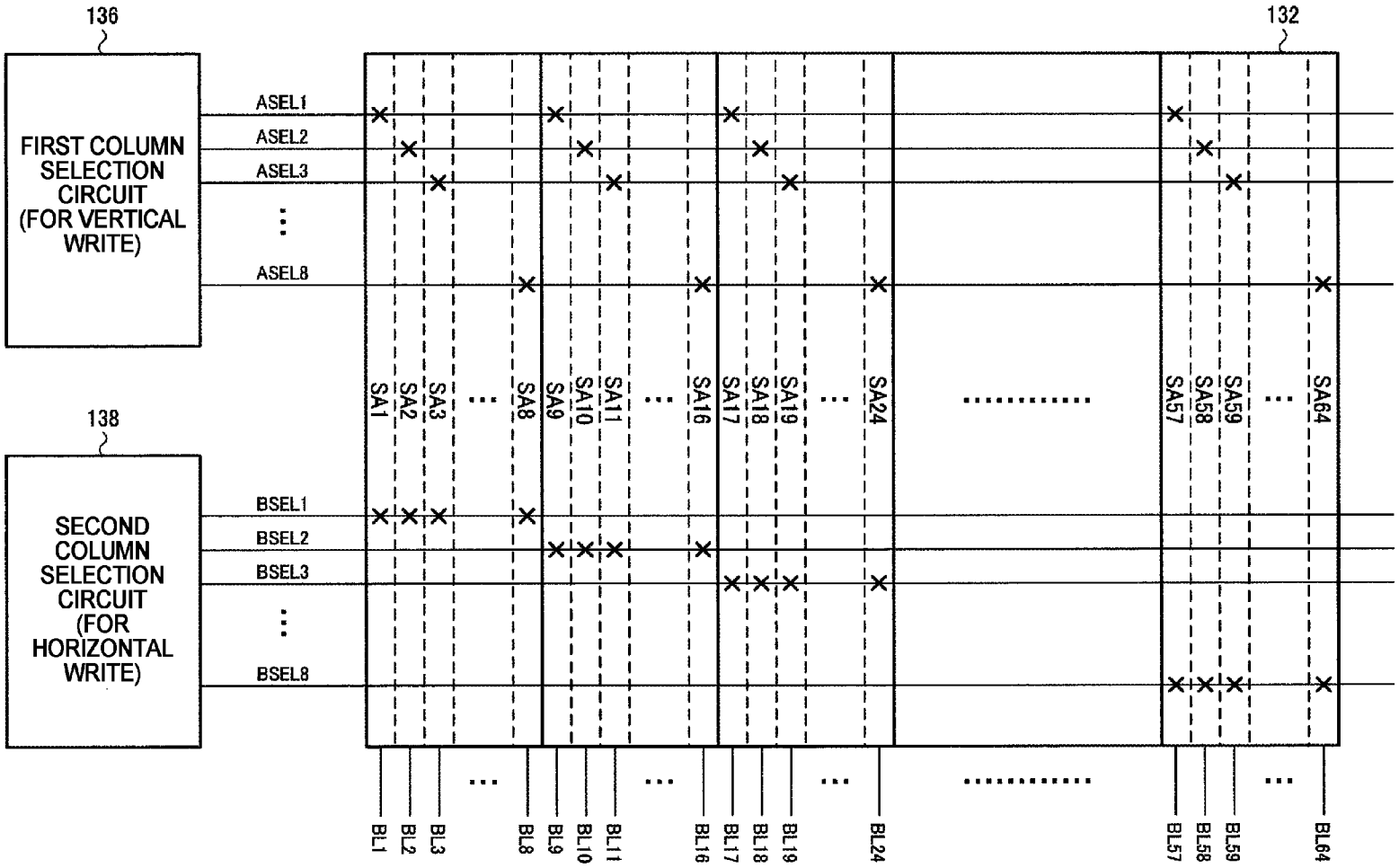
FIG. 11 shows an exemplary connection configuration of a first column selection circuit, a second column selection circuit, and a sense amplifier group.

An exemplary connection configuration of the first column selection circuit 136, the second column selection circuit 138, and the sense amplifier group 135 is shown in FIG. 11.

The first column selection circuit 136 outputs signals ASEL1 to ASEL8 based on the signals SEL1 to SEL8. A signal line of the signal ASEL1 is connected to output switch circuits of the sense amplifier units SA1, SA9, SA17, . . . , SA57, and a signal line of the signal ASEL2 is connected to output switch circuits of the amplifier units SA2, SA10, SA18, . . . , SA58. In a similar manner, a signal line of the signal ASEL8 is connected to output switch circuits of the sense amplifier units SA8, SA16, SA24, . . . , SA64.

The first column selection circuit 136, in the case where the mode setting signal WMD is at the logic level that indicates the first mode, causes the signals SEL1 to SEL8 to pass through in a period defined by a clock signal CK (in a period in which the clock signal CK is active), and outputs the signals SEL1 to SEL8 as the signals ASEL1 to ASEL8. The clock signal CK is a signal that is supplied from the read/write control circuit 160, and is a signal that is activated in a period when readout from the memory cell array 120 is being performed.

For example, in the case of the column address CAL[2:0]=LLL, the signal ASEL1 is activated in a period in which the clock signal CK is activated, outputs of the sense amplifier units SA1, SA9, SA17, . . . , SA57 are selected, and readout from the bit lines BL1, BL9, BL17, BL57 is performed.

The second column selection circuit 138 outputs signals BSEL1 to BSEL8 based on the signals SEL1 to SEL8. A signal line of the signal BSEL1 is connected to the output switch circuits of the sense amplifier units SA1 to SA8, and a signal line of the signal BSEL2 is connected to the output switch circuits of the sense amplifier units SA9 to SA16. In a similar manner, a signal line of the signal BSEL8 is connected to the output switch circuits of the sense amplifier units SA57 to SA64.

The second column selection circuit 138, in the case where the mode setting signal WMD is at the logic level that indicates the second mode, causes the signals SEL1 to SEL8 to pass through in a period defined by the clock signal CK (in a period in which the clock signal CK is active), and outputs the signals SEL1 to SEL8 as the signals BSEL1 to BSEL8.

For example, in the case of the column address CAL[2:0]=LLL, the signal BSEL1 is activated in a period in which the clock signal CK is activated, outputs of the sense amplifier units SA1 to SA8 are selected, and readout from the bit lines BL1 to BL8 is performed.

Next, the sense amplifier group 135 and the selector 131 will be described.

Each sense amplifier unit of the sense amplifier units SA1 to SA64 includes a first output line for the first mode (vertical write mode) and a second output line for the second mode (horizontal write mode), as shown in FIG. 10.

A first bus BUSA is constituted by the first output lines (plurality of first output lines) of the sense amplifier units SA1 to SA64, and a second bus BUSB is constituted by the second output lines (plurality of second output lines) of the sense amplifier units SA1 to SA64. The selector 131 selects the first bus BUSA in the first mode and selects the second bus BUSB in the second mode.

The first output lines are output lines that are output-enabled in the case of being selected by the first column selection circuit 136 (in the vertical write mode), and read signals QA1 to QA64 in the vertical write mode are output to the first bus BUSA. Specifically, the first bus BUSA is constituted by first to eighth signal lines that correspond to 8-bit read signals in the vertical write mode. Each signal line connects to the first output line, from the first output lines (NQA in FIG. 12) of the sense amplifier units SA1 to SA64, that corresponds to the same bit. That is, the first signal line connects to the first output lines of the sense amplifier units SA1 to SA8, and the second signal line connects to the first output lines of the sense amplifier units SA9 to SA16. In a similar manner, the eighth signal line connects to the first output lines of the sense amplifier units SA57 to SA64. For example, in the case where the signal ASEL1 is activated in FIG. 11, the outputs of the sense amplifier units SA1, SA9, SA17, . . . , SA57 are selected, and the outputs of unselected sense amplifier units enter a high-impedance state. As a result, the eight read signals QA1, QA9, QA17, . . . , QA57 that are outputs of the sense amplifier units SA1, SA9, SA17, . . . , SA57 are output to the first to eighth signal lines of the first bus BUSA. Although the outputs of the sense amplifier units SA1 to SA8 are connected to the first signal line of the first bus BUSA, the outputs of the sense amplifier units SA2 to SA8 are in a high-impedance state, and as a result the read signal QA1 of the sense amplifier unit SA1 (bit line BL1) is output to the first signal line of the first bus BUSA, for example.

In the vertical write mode, all the signals BSEL1 to BSEL8 are inactivated, and all the second output lines of the sense amplifier units SA1 to SA64 are in a high-impedance state. The latch circuit LTCB shown in FIG. 10 is in an on state based on the mode setting signal WMD, and signals that were read out previously in the horizontal write mode are latched, for example. The latch circuit LTCA is in an off state (in a state in which latched data is not output) based on the mode setting signal WMD.

The second output lines are output lines that are output-enabled in the case of being selected by the second column selection circuit 138 (in the horizontal write mode), and read signals QB1 to QB64 in the horizontal write mode are output to the second bus BUSB. Specifically, the second bus BUSB is constituted by first to eighth signal lines that correspond to 8-bit read signals in the horizontal write mode. Each signal line connects to the second output line, from the second output lines (NQB in FIG. 12) of the sense amplifier units SA1 to SA64, that corresponds to the same bit. That is, the first signal line connects to the second output lines of the sense amplifier units SA1, SA9, SA17, . . . , SA57, and the second signal line connects to the second output lines of the sense amplifier units SA2, SA10, SA18, . . . , SA58. In a similar manner, the eighth signal line connects to the second output lines of the sense amplifier units SA8, SA16, SA24, . . . , SA64. For example, in the case where the signal BSEL1 is activated in FIG. 11, the outputs of the sense amplifier units SA1 to SA8 are selected, and the outputs of unselected sense amplifier units enter a high-impedance state. As a result, the eight read signals QB1 to QB8 that are outputs of the sense amplifier units SA1 to SA8 are output to the first to eighth signal lines of the second bus BUSB. Although the outputs of the sense amplifier units SA1, SA9, SA17, . . . , SA57 are connected to the first signal line of the second bus BUSB, the outputs of the sense amplifier units SA9, SA17, . . . , SA57 are in a high-impedance state, and as a result the read signal QB1 of the sense amplifier unit SA1 (bit line BL1) is output to the first signal line of the second bus BUSB, for example.

In the horizontal write mode, all the signals ASEL1 to ASEL8 are inactivated, and all the first output lines of the sense amplifier units SA1 to SA64 are in a high-impedance state. The latch circuit LTCA shown in FIG. 10 is in an on state based on the mode setting signal WMD, and signals that were read out previously in the vertical write mode are latched, for example. The latch circuit LTCB is in an off state (in a state in which latched data is not output) based on the mode setting signal WMD.

The selector 131 outputs the signals (8-bit read signals in the vertical write mode) on the first bus BUSA or the signals (8-bit read signals in the horizontal write mode) on the second bus BUSB based on the mode setting signal WMD.

As described with reference to FIG. 11 and the like, since the selected bit lines with respect to the same column address CAL[2:0] are different between the vertical write mode and the horizontal write mode, the connection between the first column selection circuit and the sense amplifier units SA1 to SA64 is different from the connection between the second column selection circuit and the sense amplifier units SA1 to SA64. In this embodiment, by providing two output lines for the vertical write mode and the horizontal write mode to one sense amplifier unit, these two connections can coexist, and as a result readout in the two modes can be realized.

4. Sense Amplifier Unit

Figure 12:
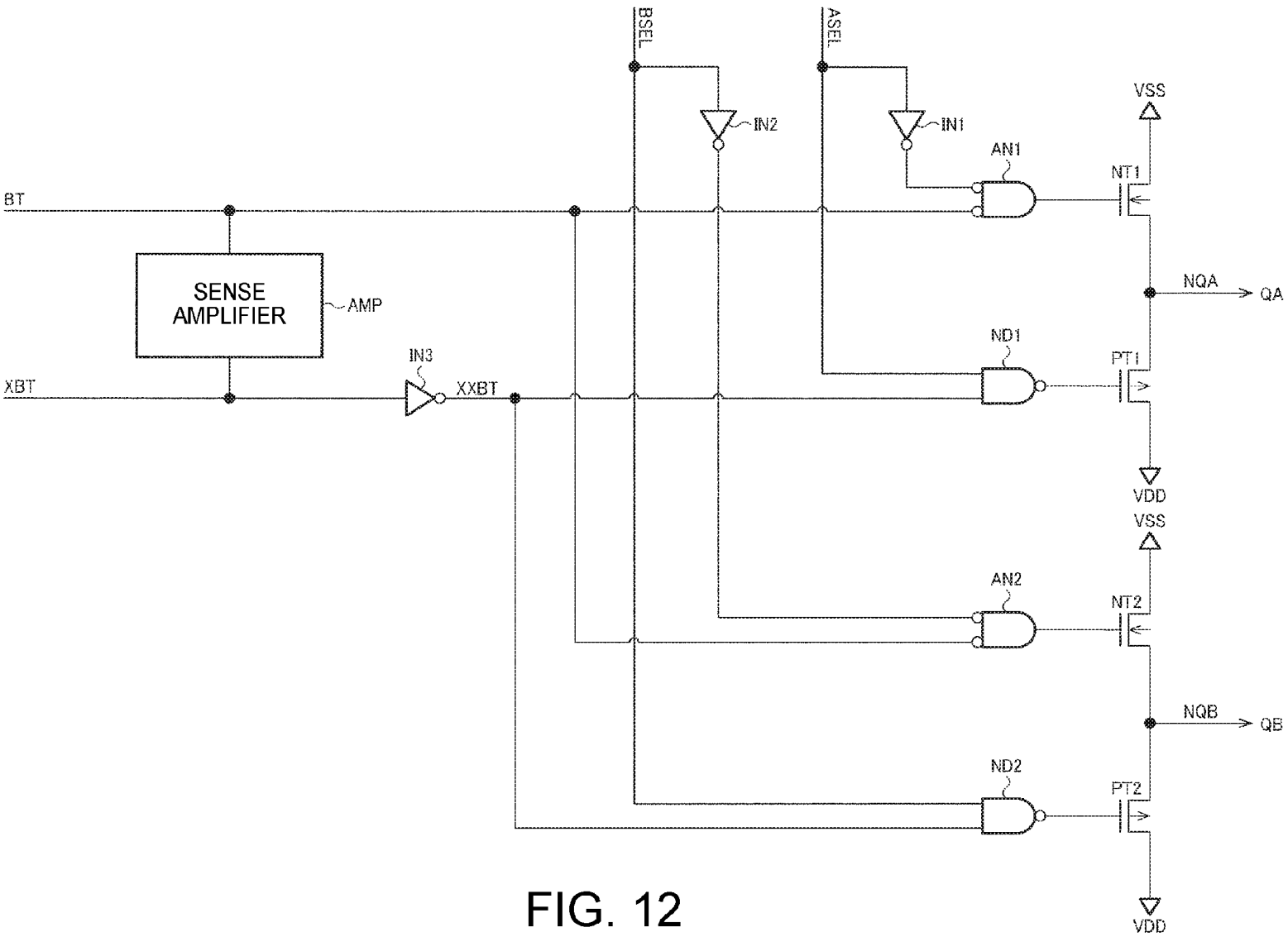
FIG. 12 shows a detailed exemplary configuration of a sense amplifier unit.

A detailed exemplary configuration of the sense amplifier unit is shown in FIG. 12. The sense amplifier unit includes a sense amplifier AMP, inverters IN1 to IN3 (logic inverting circuit), AND circuits AN1 and AN2 with inverting inputs, NAND circuits ND1 and ND2, N-type transistors NT1 and NT2, and P-type transistors PT1 and PT2.

The sense amplifier AMP reads out data from a memory cell by amplifying a non-inverting output signal BT and an inverting output signal XBT from the memory cell and determining the data. The inverter IN3 logically inverts the signal XBT and outputs a signal XXBT having the same logic as the signal BT.

The signal ASEL is a signal (any one of signals ASEL1 to ASEL8) that is input from the first column selection circuit 136, and the signal BSEL is a signal (any one of signals BSEL1 to BSEL8) that is input from the second column selection circuit 138.

First, in the case where the signal ASEL is at a high level (active), the AND circuit AN1 outputs a logically inverted signal of the signal BT, and the NAND circuit ND1 outputs a logically inverted signal of the signal XXBT. In the case where the signal BT(=XXBT) is at a high level, because the AND circuit AN1 and the NAND circuit ND1 output low level signals, the P-type transistor PT1 is turned on, and the signal QA on the first output line NQA attains a high level (VDD). On the other hand, in the case where the signal BT(=XXBT) is at a low level, because the AND circuit AN1 and the NAND circuit ND1 output high level signals, the N-type transistor NT1 is turned on and the signal QA on the first output line NQA attains a low level (VSS).

In the case where the signal ASEL is at a low level (inactive), the AND circuit AN1 outputs a low level signal, and the NAND circuit ND1 outputs a high level signal. Therefore, the N-type transistor and the P-type transistor PT1 are turned off, and the first output line NQA enters a high-impedance state.

As for the signal BSEL also, in the case where the signal BSEL is at a high level (active), the signal QB at the same logic level as the signal BT is output to the second output line NQB. In the case where the signal BSEL is at a low level (inactive), the second output line NQB enters a high-impedance state.

As described above, the sense amplifier units selected by the first column selection circuit 136 outputs read signals to the first output lines NQA in the vertical write mode, and the sense amplifier units selected by the second column selection circuit 138 output read signals to the second output lines NQB in the horizontal write mode.

5. Electro-Optical Device and Electronic Apparatus

Figure 13:
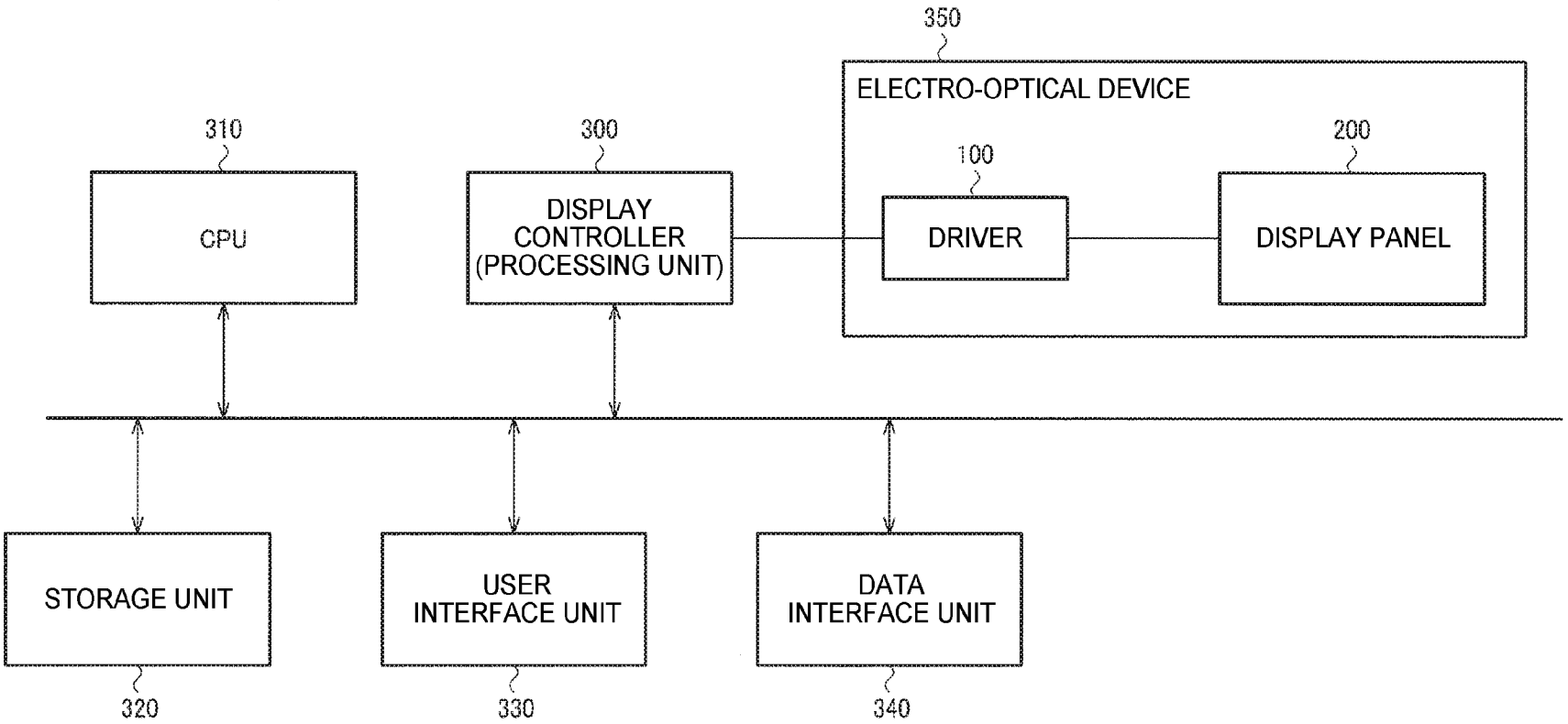
FIG. 13 is an exemplary configuration of an electro-optical device and an electronic apparatus.

FIG. 13 shows an exemplary configuration of an electro-optical device and an electronic apparatus to which the driver 100 according to this embodiment can be applied. Various electronic apparatuses equipped with a display apparatus, such as a projector, a television device, an information processing device (computer), a mobile information terminal, a car navigation system, and a mobile game terminal, can be assumed to be the electronic apparatus according to this embodiment.

The electronic apparatus shown in FIG. 13 includes an electro-optical device 350, a display controller 300 (host controller; first processing unit), a CPU 310 (second processing unit), a storage unit 320, a user interface unit 330, and a data interface unit 340. The electro-optical device 350 includes the driver 100 and the display panel 200.

The display panel 200 is a matrix type liquid crystal display panel, for example. Alternatively, the display panel 200 may be an EL (Electro-Luminescence) display panel using self-luminous elements. For example, a flexible substrate is connected to the display panel 200, the driver 100 (integrated circuit device) is installed in this flexible substrate, and as a result the electro-optical device 350 is configured. Note that the driver 100 and the display panel 200 may be incorporated as individual components in the electronic device, rather than being configured as the electro-optical device 350. For example, a configuration may be employed in which a flexible substrate for leading out interconnects is connected to the display panel 200, the driver 100 is installed together with the display controller 300 or the like in a rigid substrate, and the flexible substrate is connected to this rigid substrate, and thus the display panel 200 is installed.

The user interface unit 330 is an interface unit that accepts various user operations. For example, the user interface unit 330 is constituted by buttons, a mouse, a keyboard, a touch panel installed in the display panel 200, or the like. The data interface unit 340 is an interface unit that inputs and outputs image data and control data. For example, the data interface unit 340 is a wired communication interface such as a USB, or a wireless communication interface such as a wireless LAN. The storage unit 320 stores the image data that is input from the data interface unit 340. Alternatively, the storage unit 320 functions as a work memory of the CPU 310, the display controller 300, or the like. The CPU 310 performs control processing for each part of the electronic device, various kinds of data processing. The display controller 300 performs control processing for the driver 100. For example, the display controller 300 converts image data transferred from the data interface unit 340, the storage unit 320, or the like into a format that can be accepted by the driver 100, and outputs the converted image data to the driver 100. The driver 100 drives the display panel 200 based on the image data transferred from the display controller 300.

Note that although this embodiment has been described above in detail, those skilled in the art will easily understand that various modifications are possible without substantially departing from the new matter and the effect of the invention. Accordingly, all those modifications are to be encompassed in the scope of the invention. For example, a term that is used at least once together with another term having a broader or the same meaning in the specification or the drawings may be replaced with the other term in any part of the specification or the drawings. All combinations of this embodiment and the modifications are also encompassed in the scope of the invention. Configurations, operations, or the like of the read circuit, the write circuit, the memory cell array, the storage device, the driver, the electro-optical device, and the electronic apparatus are not limited to those described in this embodiment either, and may be modified in various manners.

This application claims priority from Japanese Patent Application No. 2015-066224 filed in the Japanese Patent Office on Mar. 27, 2015 the entire disclosure of which is hereby incorporated by reference in its entirely.

What is claimed is:

1. A storage device comprising:

a memory cell array into which monochrome display data is to be written;

a write circuit configured to write the display data into the memory cell array; and a read circuit configured to read out the written display data from the memory cell array, wherein the write circuit, in a first mode, writes a plurality of first pixel data units, each of the first pixel data units being constituted by data for pixels, each of the pixels are connected to the same data line and are connected to different scan lines in a display panel, into a plurality of memory cells connected to a selected word line, and in a second mode, writes a plurality of second pixel data units, each of the second pixel data units being constituted by data for pixels that are connected to the same scan line and are connected to different data lines in the display panel, into a plurality of memory cells connected to a selected word line, wherein the read circuit is further configured to:

receive a mode setting signal of the first mode or the second mode, and when the first mode is set based on the mode setting signal, perform first bit line selection processing in which data for pixels that are on the same scan line is selected from the plurality of first pixel data units, and when the second mode is selected based on the mode setting signal, perform second bit line selection processing in which pixel data that is the second pixel data unit is selected, wherein the read circuit includes:

a column address decoder configured to output signals;

a first column selection circuit configured to receive the output signals of the column address decoder and the mode setting signal, and perform the first bit line selection processing for the first mode based on the output signals; and a second column selection circuit configured to receive the output signals of the column address decoder and the mode setting signal, and perform the second bit line selection processing for the second mode based on the output signals, and wherein the first column selection circuit is different from the second column selection circuit, the first column selection circuit outputting first signals ASEL1 to ASEL8 based on the output signals of the column address decoder, and the second column selection circuit outputting second signals BSEL1 to BSEL8 based on the output signals of the column address decoder.

2. The storage device according to claim 1, wherein the read circuit is configured to, in the first mode, select and read out data for pixels that are on the same scan line from the plurality of first pixel data units.

3. The storage device according to claim 1, wherein the read circuit includes a plurality of sense amplifier units each configured to amplify a read signal from the memory cell array, and each of the plurality of sense amplifier units includes a first output line for the first mode and a second output line for the second mode.

4. The storage device according to claim 3, wherein the read circuit includes:

a first bus constituted by a plurality of the first output lines, a second bus constituted by a plurality of the second output lines, and a selector configured to select the first bus in the first mode, and select the second bus in the second mode.

5. A display driver comprising:

the storage device according to claim 1; and a drive circuit configured to drive the display panel based on the display data that is read out from the storage device.

6. An electro-optical device comprising:

the display driver according to claim 5; and the display panel.

7. An electronic apparatus comprising:

the storage device according to claim 1.

8. A storage device comprising:

a memory cell array that stores display data, the display data corresponding to each of pixels is binary data, respectively;

a write circuit configured to write the display data to the memory cell array; and a read circuit configured to read out the display data from the memory cell array, in a first mode, the write circuit writes a first data unit into a plurality of memory cells connected to a word line, the first data unit being constituted by data for pixels that are connected with the same data line and are connected with different scan lines in the display device, and in a second mode, the write circuit writes a first data unit into a plurality of memory cells connected to a word line, the second data unit being constituted by data for pixels that are connected with the same scan line and are connected with different data lines in the display device, wherein the read circuit is further configured to:

receive a mode setting signal of the first mode or the second mode, and when the first mode is set based on the mode setting signal, perform first bit line selection processing in which data for pixels that are on the same scan line is selected from the plurality of first pixel data units, and when the second mode is selected based on the mode setting signal, perform second bit line selection processing in which pixel data that is the second pixel data unit is selected, wherein the read circuit includes:

a column address decoder configured to output signals;

a first column selection circuit configured to receive the output signals of the column address decoder and the mode setting signal, and perform the first bit line selection processing for the first mode based on the output signals; and a second column selection circuit configured to receive the output signals of the column address decoder and the mode setting signal, and perform the second bit line selection processing for the second mode based on the output signals, and wherein the first column selection circuit is different from the second column selection circuit, the first column selection circuit outputting first signals ASEL1 to ASEL8 based on the output signals of the column address decoder, and the second column selection circuit outputting second signals BSEL1 to BSEL8 based on the output signals of the column address decoder.

* * * * *